US007780158B2

(12) United States Patent
Fujii et al.

(10) Patent No.: US 7,780,158 B2
(45) Date of Patent: Aug. 24, 2010

(54) POST-PROCESSING APPARATUS, CONTROL METHOD THEREFOR, AND POST-PROCESSING SYSTEM

(75) Inventors: Takayuki Fujii, Toshima-ku (JP); Toshiyuki Miyake, Toride (JP); Yasuo Fukatsu, Abiko (JP); Takako Hanada, Yokohama (JP); Yusuke Obuchi, Abiko (JP); Atsuteru Oikawa, Hino (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/430,239

(22) Filed: Apr. 27, 2009

(65) Prior Publication Data

US 2009/0206538 A1 Aug. 20, 2009

Related U.S. Application Data

(63) Continuation of application No. 11/468,212, filed on Aug. 29, 2006, now Pat. No. 7,540,482.

(30) Foreign Application Priority Data

Aug. 31, 2005 (JP) ..... 2005-252338

(51) Int. Cl.
*B65H 39/00* (2006.01)

(52) U.S. Cl. ..... 270/58.1; 270/58.08; 270/58.09; 270/58.14; 270/58.18

(58) Field of Classification Search ..... 270/58.1, 270/58.14, 58.18, 58.08, 58.09; 271/285
See application file for complete search history.

(56) References Cited

U.S. PATENT DOCUMENTS 6,517,065 B2 2/2003 Miyake et al.
7,389,980 B2 * 6/2008 Kushida ..... 270/58.12
7,401,776 B2 * 7/2008 Obuchi et al. ..... 271/228
7,445,207 B2 * 11/2008 Obuchi et al. ..... 271/228
7,575,230 B2 * 8/2009 Kamiya et al. ..... 270/58.12

FOREIGN PATENT DOCUMENTS

| | | | |
|---|---|---|---|
| JP | 10-194582 | A | 7/1998 |
| JP | 2000-327208 | A | 11/2000 |
| JP | 2000-351522 | A | 12/2000 |
| JP | 2003-261258 | A | 9/2003 |
| JP | 2004-091129 | A | 3/2004 |
| JP | 2005-170676 | A | 6/2005 |

* cited by examiner

*Primary Examiner*—Leslie A Nicholson, III
(74) *Attorney, Agent, or Firm*—Rossi, Kimms & McDowell LLP

(57) ABSTRACT

Provided is a post-processing apparatus which sequentially receives sheets one by one from an image forming apparatus to execute a post-processing on the sheets, including: a first transport device which receives the sheets delivered from the image forming apparatus and transports the sheets; a sheet overlap device which stays the sheets transported by the first transport device and causes another sheet transported sequentially by the first transport device to overlap at least one stayed sheet; a second transport device which transports a plurality of sheets overlapping each other by the sheet overlap device; a plurality of stacking devices capable of stacking a plurality of sheets transported by the second transport device; and a controller which changes control of sheet overlapping caused by the sheet overlap device depending on which stacking device selected from among the plurality of stacking devices the sheets are to be transported to.

6 Claims, 30 Drawing Sheets

POST-PROCESSING APPARATUS, CONTROL METHOD THEREFOR, AND POST-PROCESSING SYSTEM

This is a continuation of and claims priority from U.S. patent application Ser. No. 11/468,212 filed Aug. 29, 2006, the content of which is incorporated herein by reference.

BACKGROUND OF THE INVENTION

1. Field of the Invention

The present invention relates to a post-processing apparatus, a control method therefor, and a post-processing system that are used in an image forming apparatus such as a copying machine and a laser beam printer.

2. Description of the Related Art

Up to now, in an image forming apparatus such as a copying machine, a post-processing apparatus such as a finisher is connected to an image forming apparatus main body to provide various post-processes required by a user such as a sheet-bundle deliver process and a staple process.

The post-processing apparatus receives image-formed sheets, which are delivered one by one from an image forming apparatus, to obtain a sheet bundle by causing the plurality of sheets to overlap each other. The post-processing apparatus includes an intermediate tray which is used for executing a staple process with respect to the sheet bundle, and a stack tray which receives the sheet bundle produced on the intermediate tray and delivered onto the stack tray.

In addition, the post-processing apparatus executes sheet alignment in a transport direction on the intermediate tray every time the sheet is delivered onto the intermediate tray. Further, when sheets corresponding to a sheet bundle are delivered onto the intermediate tray, in addition to the sheet alignment, a sheet-bundle delivery process onto the stack tray is performed after the staple process or the like has been applied. After the sheet-bundle delivery process has been executed, it is possible to deliver another sheet onto the intermediate tray.

Accordingly, it is necessary to adjust a delivery timing of another sheet by considering time required for completing the sheet bundle delivery process.

In order to adjust the delivery timing, first, there is a method in which the image forming apparatus adjusts an image forming timing for each sheet according to time required for performing a variety of processes, thereby adjusting a delivery time of each sheet to be delivered onto the post-processing apparatus from the image forming apparatus. However, when the method is adopted, it is difficult to uniform time intervals required for executing image formation with respect to sheets, which results in lowering productivity.

Second, there is a method (i.e., buffering method) in which, after the sheets delivered from the image forming apparatus are received by the post-processing apparatus, the sheets are allowed to stand by until a predetermined number of sheets are accumulated halfway in a transport path to be delivered onto the intermediate tray, and when the predetermined number of sheets are accumulated in the transport path, the sheets are simultaneously delivered onto the intermediate tray in a state where a plurality of sheets overlap one another.

In this case, in the image forming apparatus, image formation with respect to the sheet and sheet delivery to the post-processing apparatus may be executed at predetermined time intervals irrespective of the time required for performing the post-process. As a result, it is possible to prevent the productivity from being lowered.

As the buffering method, for example, Japanese Patent Application Laid-Open No. 2000-351522 discloses a method in which leading edges of two sheets are allowed to abut against a stopper or a nip of a roller pair to cause the two sheets to overlap each other, to thereby transport the sheets to the intermediate tray. In addition, as disclosed in Japanese Patent Application Laid-Open No. 2000-327208, there is a well-known method in which sheets are allowed to stand by until a plurality of sheets are accumulated in a branch path provided for the sheets to stand by without allowing edge portions of the plurality of sheets to abut against a stopper member, to thereby guide the sheets onto the intermediate tray while the plurality of sheets are caused to overlap one another.

When a sheet bundle (i.e., a plurality of sheets) is delivered onto the intermediate tray to perform the sheet alignment in a transport direction (i.e., alignment in a vertical direction) on the intermediate tray by adopting those buffering methods, it is necessary to allow the edge portions of the sheets, which overlap one another, to reliably abut against the stopper (i.e., reference member) for aligning the sheets. When there is even a single sheet that is not abutted against the stopper, the sheets may not be aligned.

A post-processing apparatus 1 shown in FIG. 34 is provided with a buffering part 2 with respect to a plurality of intermediate trays 3 and 4. Each of the intermediate trays 3 and 4 is provided with a stoppers 3*a* and 4*a*.

FIGS. 35A and 35B are structural views each showing a partially enlarged part of the post-processing apparatus 1, and showing a state where a sheet bundle constituted of three sheets, that is, sheets P1, P2, and P3, is outputted to an intermediate tray 3 or an intermediate tray 4 from the buffering part 2. In FIG. 35A, the sheet bundle is constituted by causing the three sheets P1, P2, and P3 to overlap one another so that the sheet P1 is ahead of the sheet P2, and the sheet P2 is ahead of the sheet P3. On the other hand, in FIG. 35B, the sheet bundle is constituted by causing the three sheets P1, P2, and P3 to overlap one another so that the sheet P3 is ahead of the sheet P2 and the sheet P2 is ahead of the sheet P1.

With respect to each sheet bundle outputted to the intermediate trays 3 and 4, in a case where a lowermost sheet (i.e., sheet in contact with the intermediate tray) first abuts against stoppers 3*a* and 4*a*, the sheets sequentially abut against the stoppers 3*a* and 4*a* by their own weight in the order from the bottom. In other words, it is possible to execute sheet alignment in the sheet transport direction. Meanwhile, when an uppermost sheet first abuts against the stoppers, the sheets subsequent to the uppermost sheet and the lowermost sheet cannot abut against the stoppers by their own weight because a predetermined friction force acts on the sheets. In this case, it is impossible to execute the sheet alignment in the sheet transport direction.

In FIG. 35A, with regard to the sheet bundle outputted to the intermediate tray 4, the lowermost sheet P1 first abuts against the stopper 4*a*, thereby making it possible to execute the sheet alignment in the sheet transport direction. On the other hand, with regard to the sheet bundle outputted to the intermediate tray 3, the uppermost sheet P3 first abuts against the stopper, so it is impossible to execute the sheet alignment in the sheet transport direction.

In FIG. 35B, with regard to the sheet bundle outputted to the intermediate tray 3, the lowermost sheet P1 first abuts against the stopper 3*a*, thereby making it possible to execute the sheet alignment in the sheet transport direction. On the other hand, with regard to the sheet bundle outputted to the intermediate tray 4, the uppermost sheet P3 first abuts against the stopper, so it is impossible to perform the sheet alignment in the sheet transport direction.

As described above, in the case where the post-processing apparatus includes one buffering part with respect to a plurality of intermediate trays, when the same buffering method is carried out on all of the intermediate trays, it may be difficult to reliably perform the sheet alignment in the sheet transport direction.

Further, in a case where the post-processing apparatus includes a plurality of intermediate trays, when the buffering part is provided for each of the intermediate trays, a manufacturing cost of the post-processing apparatus is increased.

SUMMARY OF THE INVENTION

An object of the present invention is to provide a post-processing apparatus capable of executing a sheet alignment in a sheet transport direction with high accuracy and at low cost, a control method therefor, a post-processing program, and a post-processing system.

To attain the above-mentioned object, according to a first aspect of the present invention, there is provided a post-processing apparatus which sequentially receives sheets one by one from an image forming apparatus to execute a post-process on the sheets, including: a first transport device which receives sheets delivered from the image forming apparatus and transports the sheets; a sheet overlap device which stays the sheets transported by the first transport device and causes another sheet transported sequentially by the first transport device, to overlap at least one stayed sheet; a second transport device which transports a plurality of sheets overlapping each other by the sheet overlap device; a plurality of stacking devices capable of stacking a plurality of sheets transported by the second transport device; and a controller which changes control of sheet overlapping caused by the sheet overlap device depending on which stacking device selected from among the plurality of stacking devices the sheets are to be transported to.

Further, according to a second aspect of the present invention, there is provided a control method for a post-processing apparatus which sequentially receives sheets one by one from an image forming apparatus to execute a post-process on the sheets, including: a first transport step of receiving sheets delivered from the image forming apparatus to transport the sheets; a sheet overlap step of staying the sheets transported in the first transport step and causing another sheet to be transported in the first transport step to overlap at least one stayed sheet; a second transport step of transporting a plurality of sheets overlapped with each other in the sheet overlap step;

a sheet stacking step of stacking a plurality of sheets transported in the second transport step on any one of the plurality of stacking devices; and a controlling step of changing control of sheet overlapping caused in the sheet overlap step depending on which stacking device selected from among the plurality of stacking devices the sheets are to be transported to.

Further, according to a third aspect of the present invention, there is provided a post-processing system including an image forming apparatus and a post-processing apparatus which sequentially receives sheets one by one from the image forming apparatus to execute a post-process on the sheets, including: a mode selection device provided to the image forming apparatus, which selects one mode from among a plurality of modes; a deviation amount setting device provided to the image forming apparatus, which sets at least one deviation amount in a sheet transport direction among a plurality of sheets; a transmitting device provided to the image forming apparatus, which transmits to the post-processing apparatus a signal indicating the mode selected by the mode selection device and a signal indicating the deviation amount set by the deviation amount setting device; a receiving device provided to the post-processing apparatus, which receives the signal indicating the mode transmitted by the transmitting device and the signal indicating the deviation amount set by the deviation amount setting device; a first transport device provided to the post-processing apparatus, which receives the sheets delivered from the image forming apparatus and transports the sheets; a sheet overlap device provided to the post-processing apparatus, which stays the sheets transported by the first transport device and causes another sheet transported sequentially by the first transport device to overlap at least one stayed sheet; a second transport device provided to the post-processing apparatus, which transports a plurality of sheets overlapping each other by the sheet overlap device; a plurality of stacking devices provided to the post-processing apparatus, which are capable of stacking a plurality of sheets transported by the second transport device; and a controller provided to the post-processing apparatus, which selects a stacking device which stacks the plurality of sheets transported by the second transport device from among the plurality of stacking devices in response to a signal indicating a mode which is received by the receiving device, in which the controller changes control of sheet overlapping caused by the sheet overlap device depending on which stacking device selected from among the plurality of stacking devices the sheets are to be transported to.

Further features of the present invention will become apparent from the following description of exemplary embodiments with reference to the attached drawings.

DESCRIPTION OF THE EMBODIMENTS

Hereinafter, an embodiment of the present invention will be described with reference to the drawings.

Figure 1:
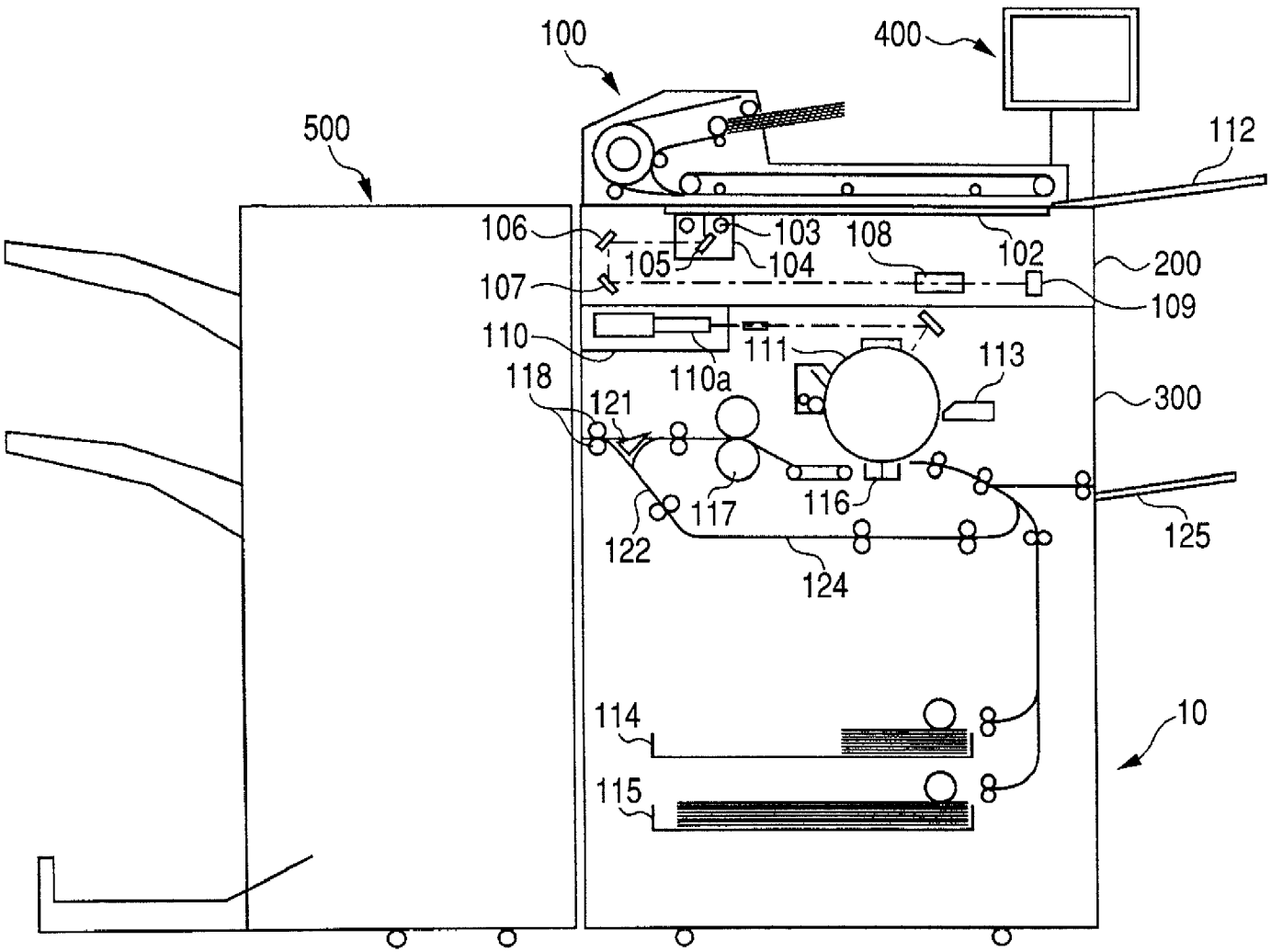
FIG. 1 is a cross-sectional view showing a structure of an image forming apparatus connected to a post-processing apparatus according to an embodiment of the present invention.

FIG. 1 is a cross-sectional view showing a structure of an image forming apparatus connected to a post-processing apparatus according to the embodiment of the present invention.

An image forming apparatus 10 is connected to a finisher 500 serving as a post-processing apparatus, and includes an image reader 200 for reading an image formed on an original, and a printer 300. Further, the image forming apparatus 10 includes an operation display device 400 which includes a plurality of keys for setting various functions related to image formation, and a display part for displaying information indicating a set state.

The image reader 200 is mounted with an original transporting device 100. The original transporting device 100 transports originals, which are set on an original tray with the original surfaces facing upward, one by one in the order from a top page to allow the originals to pass through a flow-reading position on a platen glass plate 102 through a curved path. Further, the original transporting device 100 delivers the originals, which have passed through the flow-reading position, toward a delivery tray 112.

When the originals passes through the flow-reading position on the platen glass plate 102, images formed on the originals are read by a scanner unit 104 retained at a position corresponding to the flow-reading position. This reading method is generally called an original flow-reading method. To be specific, when passing through the flow-reading position, the originals are irradiated with light of a lamp 103 provided to the scanner unit 104, and the reflected light from the originals are guided to a lens 108 through mirrors 105, 106, and 107. The light passing through the lens 108 forms an image on an image pick-up surface of an image sensor 109.

The originals are thus transported so as to pass the flow-reading position, thereby performing an original read scanning by setting a direction perpendicular to a transport direction of the original as a main scanning direction, and setting the transport direction as a sub scanning direction. In other words, when passing through the flow-reading position, the originals are transported in the sub scanning direction while the image formed on the original is read by the image sensor 109 line by line in the main scanning direction, thereby reading the entire image formed on the original. The optically-read image is converted into image data by the image sensor 109 to be outputted. The image data outputted from the image sensor 109 is subjected to a predetermined process in an image signal controller 202 to be described later, and is then inputted to an exposure controller 110 of the printer 300 as a video signal.

It should be noted that it is also possible to read the original by transporting the original onto the platen glass plate 102 to stop at a predetermined position on the platen glass plate 102 by the original transporting device 100, and by scanning the original by the scanner unit 104 from left to right in such the state. This reading method is a so-called original fixed-reading.

When the original is read without using the original transporting device 100, first, a user lifts the original transporting device 100 to place the original on the platen glass plate 102, and then the scanner unit 104 is allowed to scan the original from left to right to thereby read the original. In other words, when the original is read without using the original transporting device 100, the original fixed-reading is performed.

The exposure controller 110 of the printer 300 modulates a laser beam in response to the inputted video signal, and outputs the laser beam. The laser beam is irradiated on a photosensitive drum 111 while being scanned by a polygon mirror 110*a*. As a result, an electrostatic latent image corresponding to the scanned laser beam is formed on the photosensitive drum 111. Herein, the exposure controller 110 outputs the laser beam, as described below, so that a normal image (which is not a mirror image) is formed when the original fixed-reading is performed.

The electrostatic latent image formed on the photosensitive drum 111 is visualized as a developer image by using a developer supplied from a developing device 113. In addition, at a timing synchronized with a start of the irradiation with the laser beam, sheets are fed from any one of cassettes 114 and 115, a manual sheet feeding part 125, and a two-side transport path 124, and are transported between the photosensitive drum 111 and a transferring part 116. The developer image formed on the photosensitive drum 111 is transferred onto the sheet fed by the transferring part 116. The sheet on which the developer image is transferred is transported to a fixing part 117, and the fixing part 117 heats and pressurizes the sheet, thereby fixing the developer image on the sheet. The sheet which has passed through the fixing part 117 is delivered from the printer 300 toward an external (i.e., finisher 500) through a flapper 121 and delivery rollers 118.

Herein, when the sheet is delivered in a state where the image forming surface of the sheet faces downward (i.e., face-down), the sheet which has passed through the fixing part 117 is temporarily guided into a sheet surface reverse path 122 by a switching operation of the flapper 121, and is switched back to be delivered from the printer 300 by the delivery rollers 118 after the trailing edge of the sheet passes through the flapper 121. Hereinafter, such the sheet delivery mode is referred to as reverse delivery. The reverse delivery is performed when images are formed in the order from the top page, for example, when images read by using the original transporting device 100 are formed, or when images outputted from a computer are formed. In this case, the sheets obtained after the delivery are aligned in a correct page order.

Further, when a hard sheet such as an OHP sheet is fed from the manual sheet feeding part 125 to form an image on the sheet, the sheet is delivered by the delivery rollers 118 in a state where the image forming surface of the sheet faces upward (i.e., face-up) without being guided into the sheet surface reverse path 122. Further, in a case where a two-side recording mode for performing an image formation on both surfaces of the sheet has been set, the sheet is guided into the sheet surface reverse path 122 by the switching operation of the flapper 121 before being transported to the two-side transport path 124, thereby performing a control of re-feeding the sheet guided into the two-side transport path 124 between the photosensitive drum 111 and the transferring part 116 at the above-mentioned timing.

The sheet delivered from the printer 300 is transported to the finisher 500. In the finisher 500, a process such as a staple process is executed.

Figure 2:
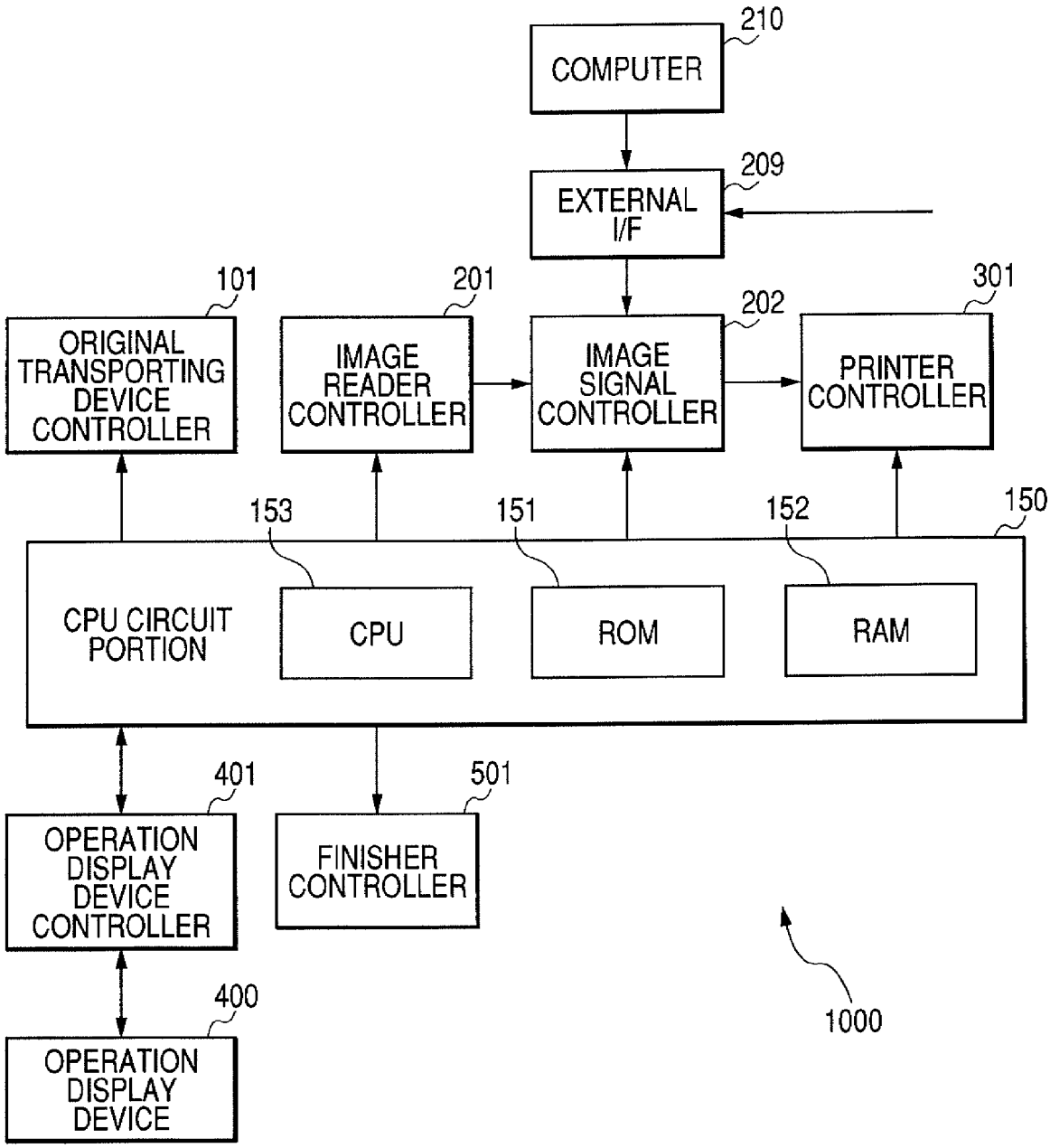
FIG. 2 is a block diagram showing a structure of a controller for controlling the image forming apparatus shown in FIG. 1.

FIG. 2 is a block diagram showing the structure of the controller for controlling the image forming apparatus shown in FIG. 1.

As shown in FIG. 2, a controller 1000 includes a CPU circuit portion 150. The CPU circuit portion 150 has a CPU 153, a ROM 151, and a RAM 152 built-in, and controls blocks 101, 201, 202, 209, 301, 401, and 701 as a whole based on a control program stored in the ROM 151. The RAM 152 temporarily stores control data and is used as a work area for arithmetic processing related to the control.

An original transporting device controller 101 drives and controls the original transporting device 100 in response to an instruction from the CPU circuit portion 150. An image reader controller 201 performs a drive control with respect to the scanner unit 104, the image sensor 109, and the like, and transfers an analog image signal outputted from the image sensor 109 to the image signal controller 202.

The image signal controller 202 converts the analog image signal outputted from the image sensor 109 into a digital signal, and then applies various processing, thereby converting the digital signal into a video signal and outputting the video signal to a printer controller 301. Further, the image signal controller 202 applies various processing to the digital image signal inputted from a computer 210 through an external I/F 209, and converts the digital image signal into the video signal, thereby outputting the video signal to the printer controller 301. The processing operations performed by the image signal controller 202 are controlled by the CPU circuit portion 150. The printer controller 301 is driven by the above-mentioned exposure controller 110 in response to the inputted video signal.

An operation display device controller 401 transmits/receives information to/from the operation display device 400 and the CPU circuit portion 150. The operation display device 400 includes a plurality of keys and a display part, outputs key signals each corresponding to operations of the keys to the CPU circuit portion 150, and displays the corresponding information on the display part in response to a signal from the CPU circuit portion 150.

A finisher controller 501 is mounted on the finisher 500 to perform the drive control of the whole finisher by transmitting/receiving information to/from the CPU circuit portion 150. A detailed description as to the control will be given later.

Figure 3:
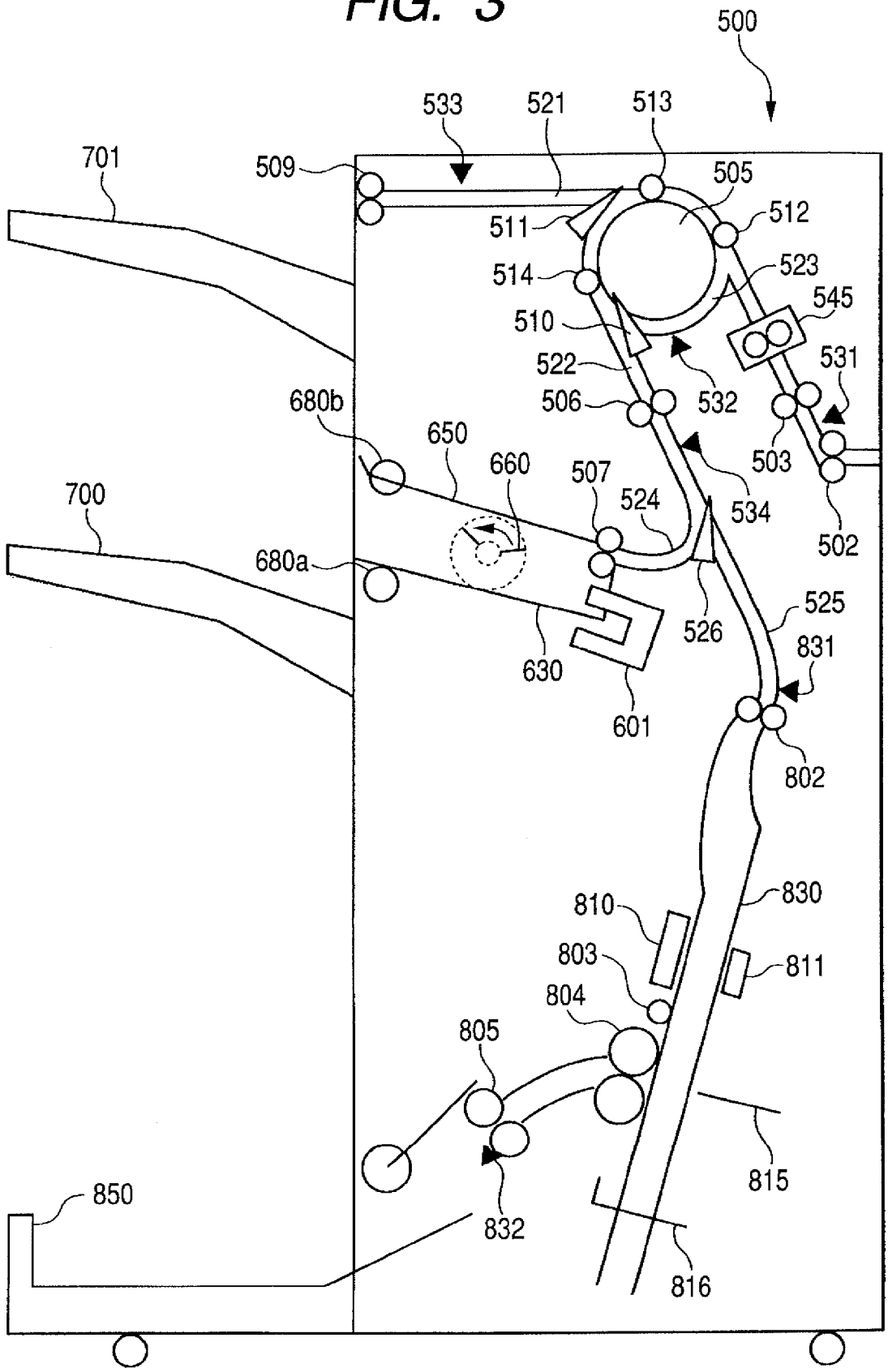
FIG. 3 is a structural view of a finisher shown in FIG. 1.

FIG. 3 is a structural view of the finisher shown in FIG. 1.

The finisher 500 performs a sheet post-process such as a bundling process in which sheets delivered from the image forming apparatus 10 are sequentially taken in and the plurality of taken sheets are aligned to obtain a bundle, a staple process in which a trailing edge of the sheet bundle is stapled, a punch process of punching holes in the vicinity of the trailing edges of the plurality of taken sheets, a sort process, a non-sort process, or a binding process.

The finisher 500 takes, as shown in FIG. 3, the sheet delivered from the image forming apparatus 10 inside the finisher 500 by an entrance roller pair 502. The sheet taken in the finisher 500 by the entrance roller pair 502 is transported toward a buffer roller 505 through a transport roller pair 503. An entrance sensor 531 is provided halfway in the transport path between the entrance roller pair 502 and the transport roller pair 503. In addition, a punch unit 545 is provided halfway in the transport path between the transport roller pair 503 and the buffer roller 505. The punch unit 545 operates according to need, and punches holes in the vicinity of the trailing edge of the transported sheet.

The buffer roller 505 is capable of winding sheets transported through the transport roller pair 503 around the outer periphery of the buffer roller 505 by staking a predetermined number of sheets. Around the outer periphery of the buffer roller 505, the sheets are wounded by press-down rollers 512, 513, and 514 while the buffer roller 505 is rotated. The wound sheets are transported in a rotation direction of the buffer roller 505. Between the press-down roller 513 and the press-down roller 514, there is provided a switching flapper 511, and on the downstream side of the press-down roller 514, there is provided a switching flapper 510.

The switching flapper 511 is provided to peel the sheets wound around the buffer roller 505 from the buffer roller 505 and guide the sheets into a non-sort path 521 or a sort path 522. The switching flapper 510 is provided to peel the sheets wound around the buffer roller 505 from the buffer roller 505 and guide the sheets into the sort path 522, or guides the sheets into a buffer path 523 in a state where the sheets wound around the buffer roller 505 are maintained to be wound around the buffer roller 505.

When the sheets wound around the buffer roller 505 are guided into the non-sort path 521, the switching flapper 511 operates to peel the sheets wound around the buffer roller 505 from the buffer roller 505 and guide the sheets to the non-sort path 521. The sheets guided into the non-sort path 521 are delivered onto a sample tray 701 through a delivery roller pair 509. Halfway in the non-sort path 521, there is provided a delivery sensor 533.

When the sheets wound around the buffer roller 505 are guided into the buffer path 523, the sheets are transported to the buffer path 523 in a state where the sheets wound around the buffer roller 505 are maintained to be wound around the buffer roller 505, without operating the switching flapper 510 and the switching flapper 511. Halfway in the buffer path 523, there is provided a buffer path sensor 532 for detecting the sheets in the buffer path 523.

When the sheets wound around the buffer roller 505 are guided into the sort path 522, the switching flapper 510 operates to peel the sheets wound around the buffer roller 505 from the buffer roller 505 without operating the switching flapper 511, thereby guiding the sheets into the sort path 522.

At a downstream of the sort path 522, there is provided the switching flapper 526 which guides the sheets to a sort delivery path 524 or a binding path 525. The sheets guided into the sort delivery path 524 are stacked on an intermediate tray (hereinafter, referred to as "process tray") 630 through a transport roller pair 507. The sheets stacked on the process tray 630 as a bundle are subjected to the alignment process, the staple process, and the like according to need, and are then delivered onto a stack tray 700 by the delivery rollers 680*a* and 680*b*. The delivery roller 680*b* is supported by a swing guide 650. The swing guide 650 is allowed to swing by a swing motor (not shown) so as to allow the delivery roller 680*b* to abut against the uppermost sheet on the process tray 630. When the delivery roller 680*b* is allowed to abut against the uppermost sheet on the process tray 630, the delivery roller 680*b* cooperates with the delivery roller 680*a* to deliver the sheet bundle on the process tray 630 toward the stack tray 700.

The above-mentioned staple process is performed by a stapler 601. The stapler 601 is structured to be movable along the outer periphery of the process tray 630 and staples the sheet bundle stacked on the process tray 630 in a rear end position (i.e., trailing edge) of the sheet bundle with respect to the sheet transport direction (i.e., leftward in FIG. 2).

Further, the sheets guided into the binding path 525 are transported to a binding intermediate tray (hereinafter, referred to as "binding process tray") 830 through a transport roller pair 802. Halfway in the binding path 525, there is provided a binding entrance sensor 831. The binding process tray 830 is provided with an intermediate roller 803 and a movable sheet positioning member 816. An anvil 811 is provided at a position opposed to two pairs of staplers 810. The staplers 810 and the anvil 811 cooperate with each other to perform the staple process with respect to the sheet bundle received in the binding process tray 830.

At the downstream of the staplers 810, there is a protruding member 815 at a position opposed to a fold roller pair 804. The protruding member 815 is allowed to protrude toward the sheet bundle received in the binding process tray 830, thereby pushing out the sheet bundle received in the binding process tray 830 as a bundle between the fold roller pair 804. The fold roller pair 804 folds the sheet bundle and transports the sheet bundle downstream. The folded sheet bundle is delivered onto a delivery tray 850 through the transport roller pair 805. At the downstream of the transport roller pair 804, there is provided a delivery sensor 832.

Figure 4:
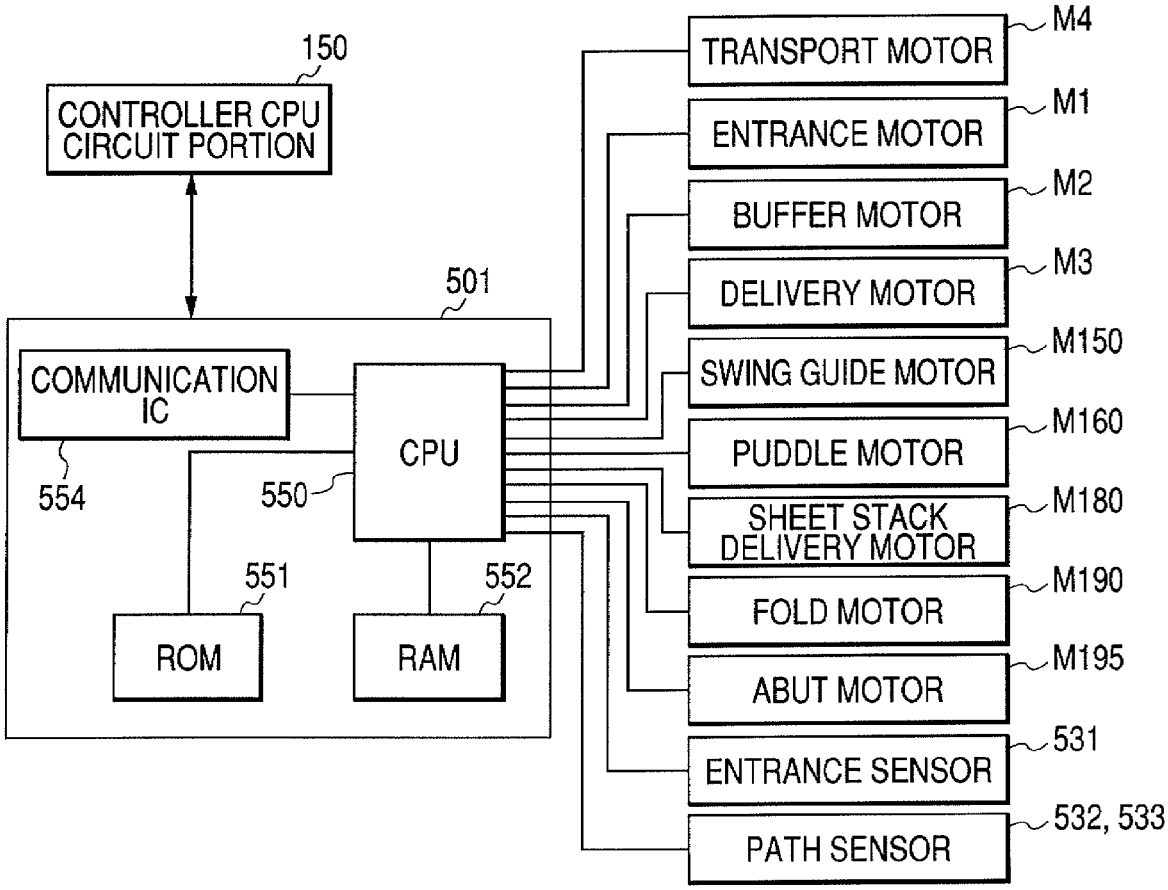
FIG. 4 is a block diagram showing a structure of finisher controller shown in FIG. 2.

FIG. 4 is a block diagram showing the structure of finisher controller shown in FIG. 2.

The finisher controller 501 drives and controls the finisher 500, and includes a CPU 550, a ROM 551, a RAM 552, and a communication IC 554. The finisher controller 501 communicates with the CPU controller 150 provided to the image forming apparatus 10 through the communication IC 554 to exchange data, thereby executing various programs stored in the ROM 551 in response to the instruction from the CPU controller 150 to drive and control the finisher 500.

The CPU 550 is connected with the ROM 551, the RAM 552, and the communication IC 554. In addition, the CPU 550 is connected with an entrance motor M1, a buffer motor M2, a delivery motor M3, a transport motor M4, a swing guide motor M150, a puddle motor M160, a sheet stack delivery motor M180, a fold motor M190, an abut motor M195, the entrance sensor 531, and the path sensors 532 and 533. The entrance motor M1 drives the entrance roller pair 502, and the buffer motor M2 drives the buffer roller 505. The delivery motor M3 drives the delivery roller pair 509 and delivery rollers 680*a* and 680*b*, and the transport motor M4 drives the transport roller pair 503. The swing guide motor M150 allows the swing guide 650 to swing, and the puddle motor M160 drives a puddle 660. The sheet stack delivery motor M180 drives the transport roller pair 805, and the fold motor M190 drives the fold roller pair 804. Further, the abut motor 195 drives and allows the protruding member 815 to protrude.

Figure 5:
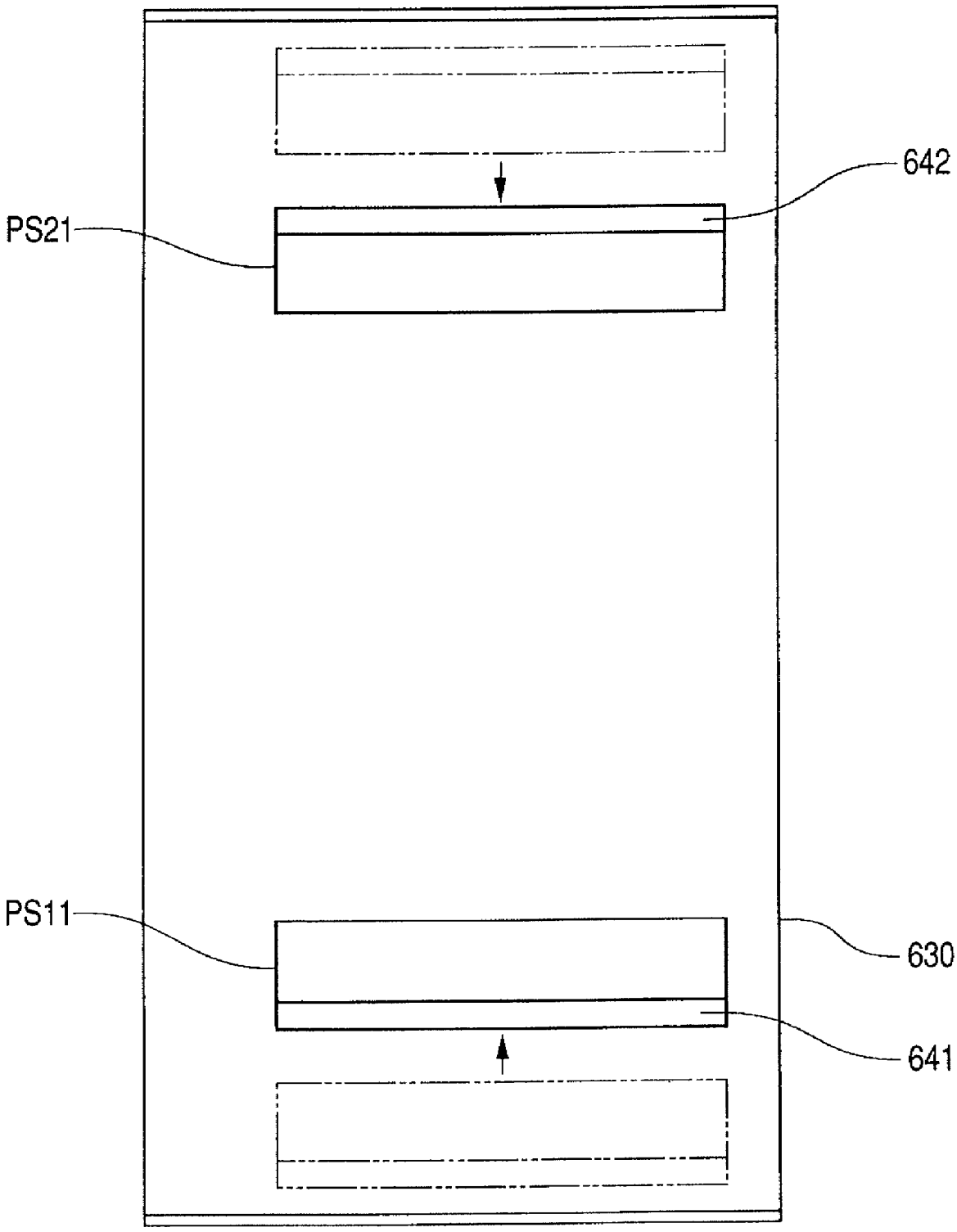
FIG. 5 is a diagram for explaining an alignment process on a process tray of the finisher shown in FIG. 3.
Figure 6:
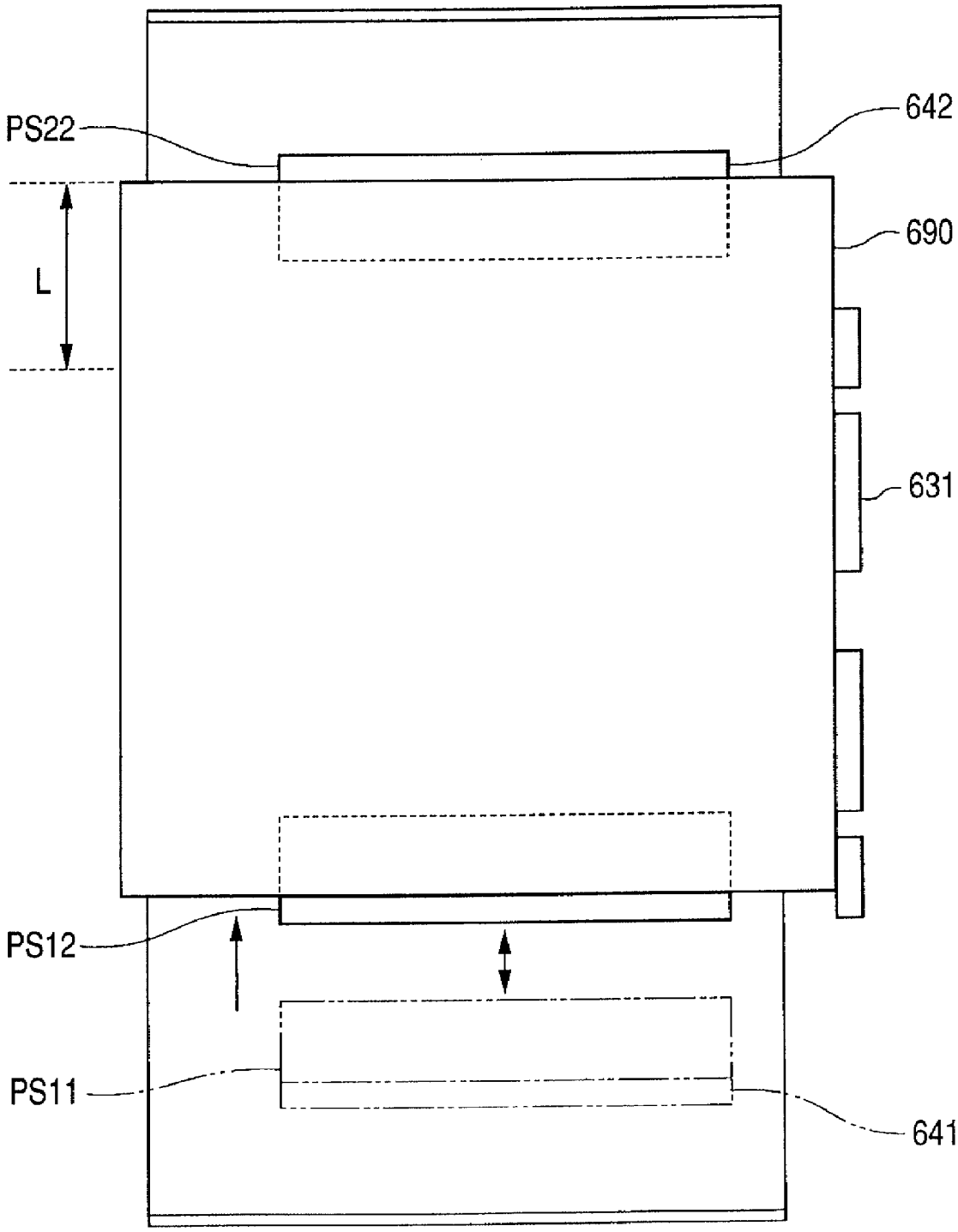
FIG. 6 is a diagram for explaining the alignment process on a process tray of the finisher shown in FIG. 3.
Figure 7:
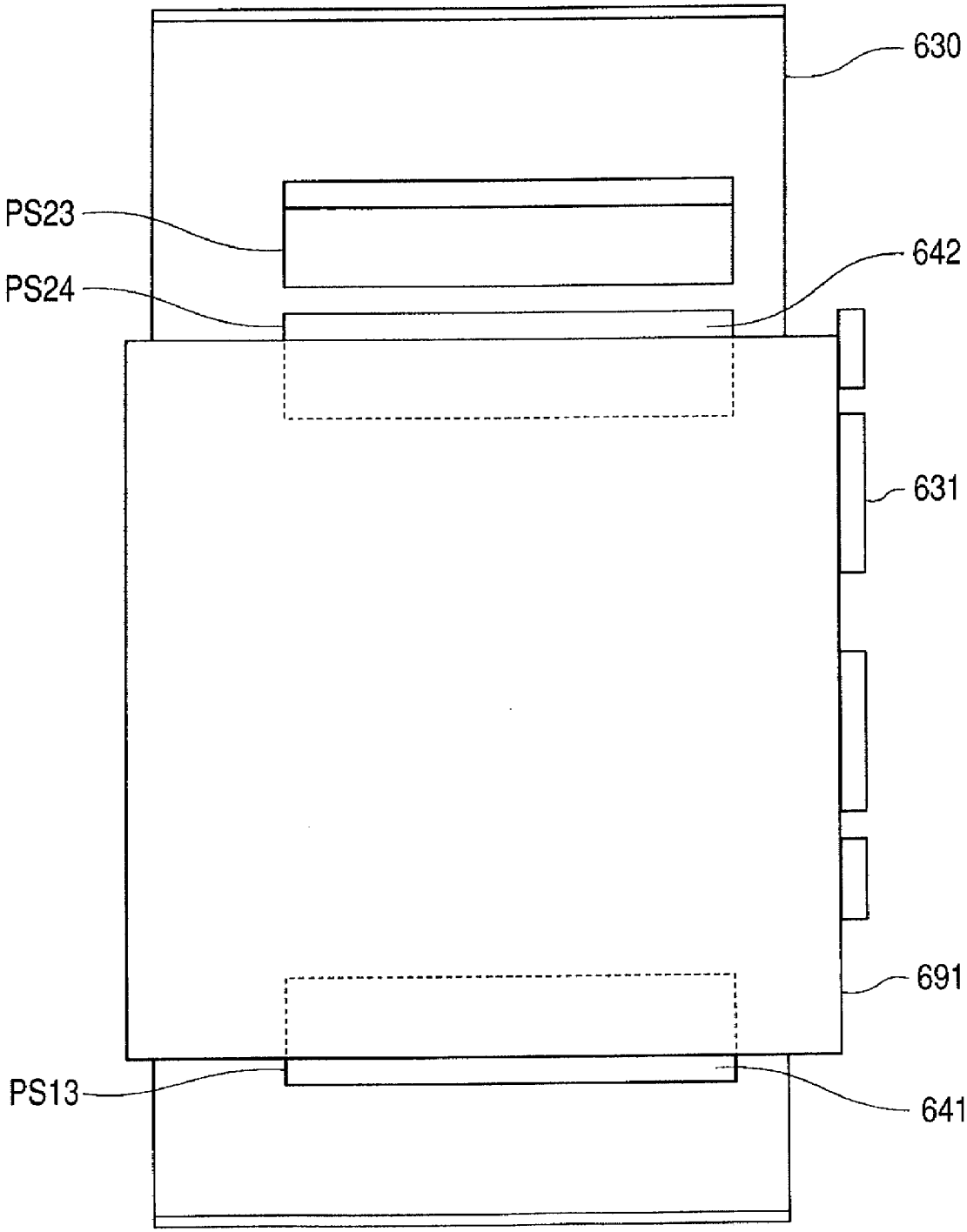
FIG. 7 is a diagram for explaining the alignment process on a process tray of the finisher shown in FIG. 3.

FIGS. 5 to 7 are diagrams for explaining the alignment process on a process tray of the finisher shown in FIG. 3.

When the first sheet is delivered from the image forming apparatus 10 onto the process tray 630, as shown in FIG. 5, a front alignment member 641 and a back alignment member 642 that are on standby at home positions (indicated by alternate long and two short dashes lines) are moved in advance to positions SP11 and PS21, respectively, where a slight play is secured with respect to the width of the sheet to be delivered. As shown in FIG. 6, the sheet delivered onto the process tray 630 is allowed to fall between the front alignment member 641 and the back alignment member 642 while the trailing edge of the sheet is supported by stoppers 631. At a timing when a lower surface of the delivered sheet is allowed to abut against a supporting surface, the front alignment member 641 is moved to a position PS12. By the movement of the front alignment member 641, the sheet is moved to a first alignment position 690 to be aligned.

After the alignment of the first sheet, the front alignment member 641 is moved to the position PS11, and stands by until the next sheet is delivered onto the process tray 630 as indicated by the broken lines of FIG. 6. When the delivery of the next sheet onto the process tray 630 is completed, the front alignment member 641 is moved to the position PS12 again, thereby aligning the second sheet at the first alignment position 690. At this time, the back alignment member 642 is maintained to be stopped at a position PS22, thereby playing a role as an alignment reference.

The above-mentioned operations are repeatedly performed until the final sheet of one sheet bundle is delivered. When the delivery and alignment of one sheet bundle is completed, delivery of another sheet bundle to be described later is performed, thereby transferring the sheet bundle to the stack tray 700.

After delivery of a first set of sheet bundle onto the stack tray 700 is completed, as shown in FIGS. 6 and 7, the front alignment member 641 is moved to a position PS13 from the position PS12, and the back alignment member 642 is moved to a position PS23 from the position PS22. Subsequently, in a similar manner as in the first set, when the first (i.e., top) sheet of a second set is delivered onto the process tray 630, the sheet is allowed to fall between the front alignment member 641 and the back alignment member 642 while the trailing edge of the sheet is supported by the stoppers 631. At a timing when a lower surface of the delivered sheet is allowed to abut against a supporting surface, the back alignment member 642 is moved to a position PS24 from the position PS23. By the movement of the back alignment member 642, the sheet is moved to a second alignment position 691 to be aligned. After the alignment of the first sheet, the back alignment member 642 is moved to the position PS23, and stands by until the next sheet is delivered onto the process tray 630.

When the delivery of the next sheet onto the process tray 630 is completed, the back alignment member 642 is moved to the position PS24 again, thereby aligning two sheets at the second alignment position 691. At this time, the front alignment member 641 is maintained to be stopped at the position PS13, thereby playing a role as an alignment reference. The above-mentioned operations are repeatedly performed until the final sheet of one sheet bundle is delivered. When the delivery and alignment of the second set of sheet bundle is completed, delivery of a sheet bundle to be described later is performed, thereby transferring the sheet bundle to the stack tray 700. The first alignment position 690 is located in a backward direction with respect to the second alignment position 691 by a predetermined amount (i.e., distance L) as shown in FIGS. 6 and 7.

Figure 8:
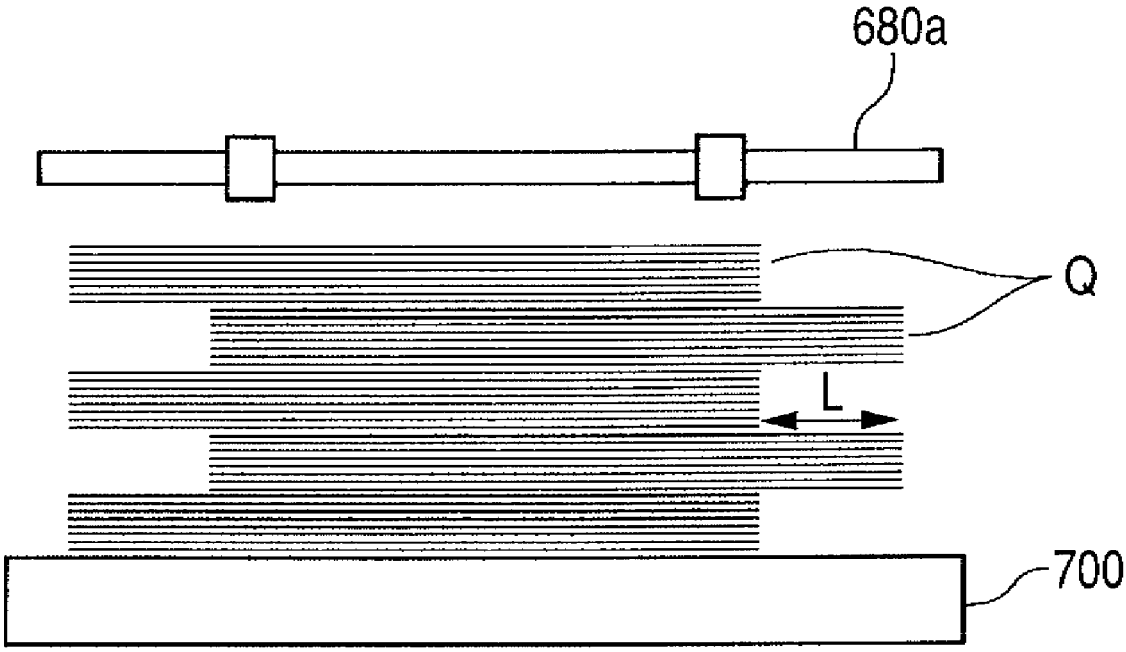
FIG. 8 is a diagram showing a state where a plurality of sheet bundles are stacked on a stack tray of the finisher.

After that, the alignment is performed while the alignment position for the respective sheet bundles are alternately changed, thereby stacking on the stack tray 700 the sheet bundles whose alignment positions are alternately changed, as shown in FIG. 8. As described above, by alternately changing the alignment positions of the respective sheet bundles, sorting of the sheet bundles with the offset distance L is to be performed.

Next, a sheet bundle delivery process will be described.

When the above-mentioned alignment process, or the staple process after the alignment process is completed, the swing guide 650 descends. After a predetermined lapse of time until a bounce of the delivery roller 680*b* is stopped since the delivery roller 680*b* has been landed on the sheet bundle, the sheet bundle is delivered onto the stack tray 700 by the delivery rollers 680*a* and 680*b*. In the delivery of the sheet bundle, a delivery speed is controlled. In other words, the CPU 550 controls the rotational speed of the delivery rollers 680*a* and 680*b* when performing the delivery speed control, thereby increasing the delivery speed so as to deliver the sheet bundle onto the stack tray 700 at a high speed. Alternatively, the CPU 550 controls the rotational speed of the delivery rollers 680*a* and 680*b* to decrease the rotational speed before the trailing edge of the sheet bundle passes through the rear ends of the delivery rollers 680*a* and 680*b* so as to obtain an appropriate speed for stacking the sheet bundle onto the stack tray 700 when the sheet bundle is delivered onto the stack tray 700.

Figure 9:
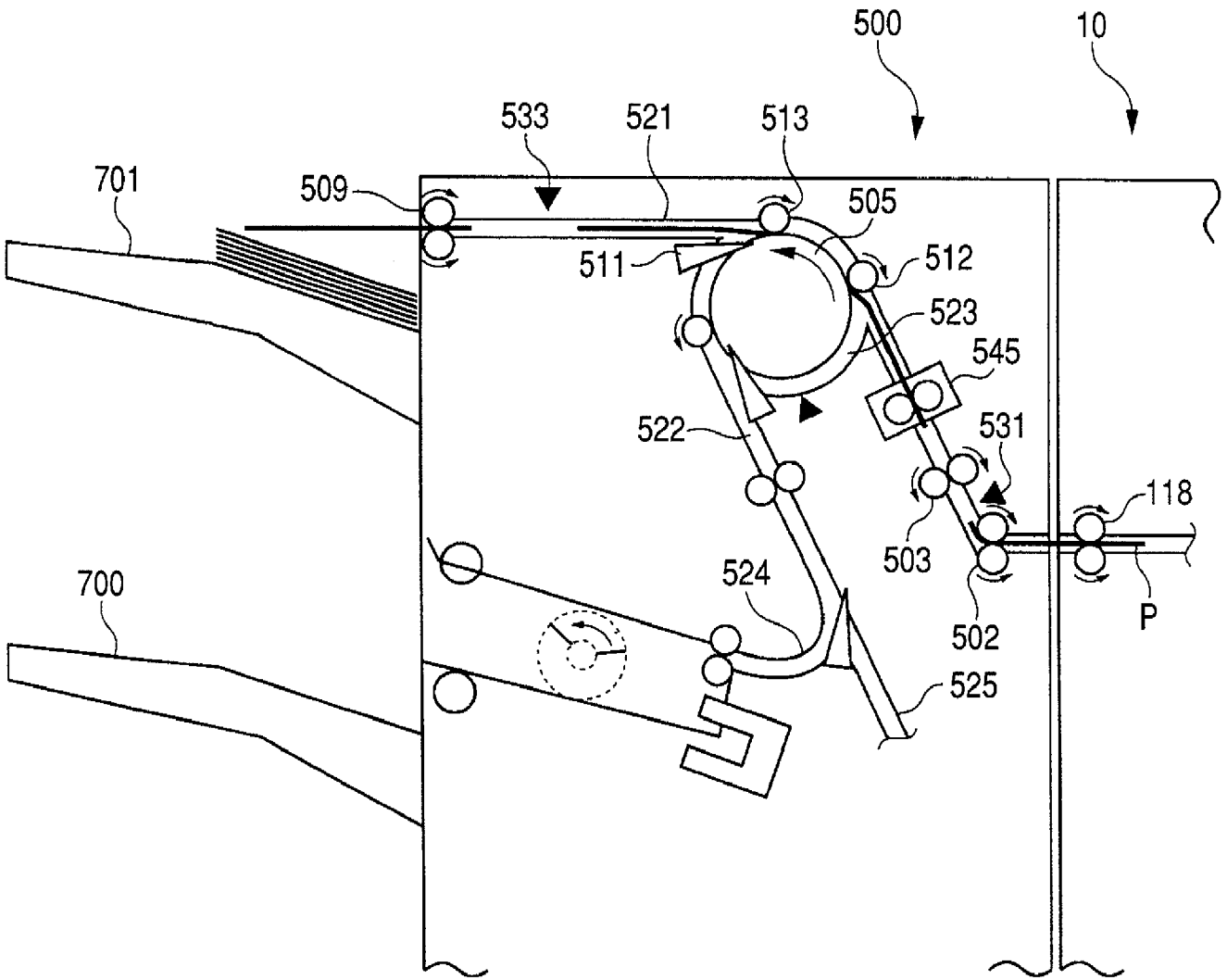
FIG. 9 is a diagram showing a passage of a sheet contained in the finisher in a non-sort mode.

FIG. 9 is a diagram showing a passage of a sheet contained in the finisher 500 in a non-sort mode.

When a user designates the non-sort mode in a delivery mode setting of the image forming apparatus 10, the entrance roller pair 502, the transport roller pair 503, and the buffer roller 505 are rotationally driven, with the result that a sheet P delivered from the image forming apparatus 10 is taken in the finisher 500 to be transported, as shown in FIG. 9. The switching flapper 511 is rotationally driven by a solenoid (not shown) at a position shown in the figure, thereby guiding the sheet P into the non-sort path 521. When the trailing edge of the sheet P is detected by the delivery sensor 533, the delivery roller pair 509 is rotated at a speed appropriate for stacking the sheet P onto the sample tray 701, thereby delivering the sheet P onto the sample tray 701. The operations of the above-mentioned various roller pairs and flappers are controlled by the CPU 550.

Figure 10:
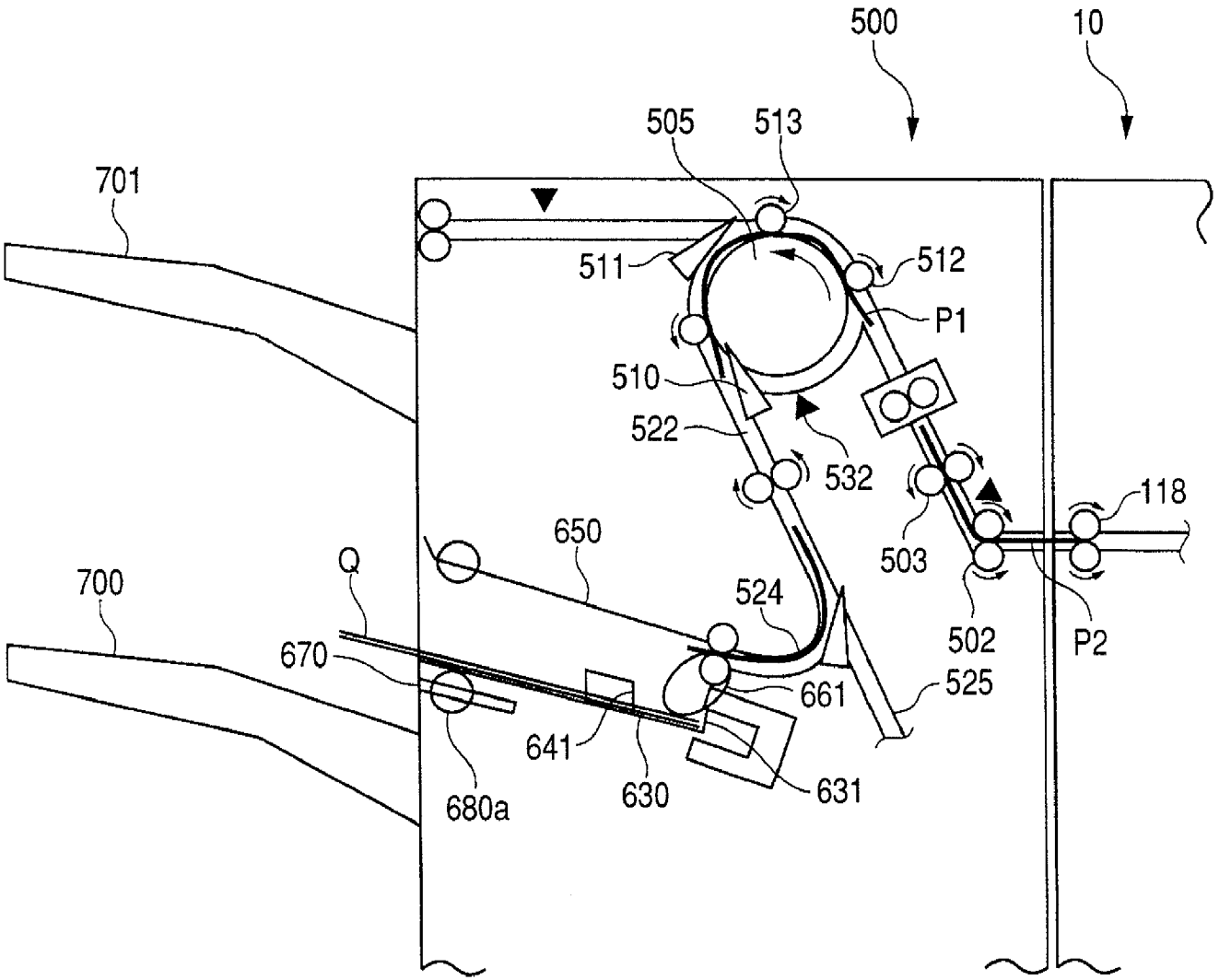
FIG. 10 is a diagram showing a passage of a sheet contained in the finisher in a sort mode.

FIG. 10 is a diagram showing a passage of a sheet contained in the finisher 500 in a sort mode, and FIG. 8 is a diagram showing a state where a plurality of sheet bundles are stacked on the stack tray 700 of the finisher 500.

When the user designates the sort mode, the entrance roller pair 502, the transport roller pair 503, and the buffer roller 505 are rotationally driven, so the sheet P delivered from the image forming apparatus 10 is taken in the finisher 500 to be transported onto the process tray 630, as shown in FIG. 10.

The switching flappers 510 and 511 are stopped at positions shown in the figure, and the sheet P is guided into the sort path 522. The sheet P guided into the sort path 522 is guided into the sort delivery path 524 by the switching flapper 512 to be delivered onto the process tray 630 by the transport roller pair 507.

In the delivery of the sheet P, by providing a advancing and retreating member 670 which is caused to protrude upward by the rotation of the delivery roller pair 680*a*, it is possible to prevent the sheet P delivered by the transport roller pair 507 from hanging down, prevent a returning failure of the sheet P, and improve an alignment property of the sheet on the process tray 630.

The sheet P delivered onto the process tray 630 starts moving toward the stoppers 631 on the process tray 630 by its own weight. The movement of the sheet P is helped by a helping member such as the puddle 660 and a returning belt 661. When the trailing edge of the sheet P is allowed to abut against the stoppers 631 to stop the sheet P, the alignment of the sheet delivered by the alignment members 641 and 642 is performed as described above. The operations of the various roller pairs and flappers are controlled by the CPU 550.

Figure 11:
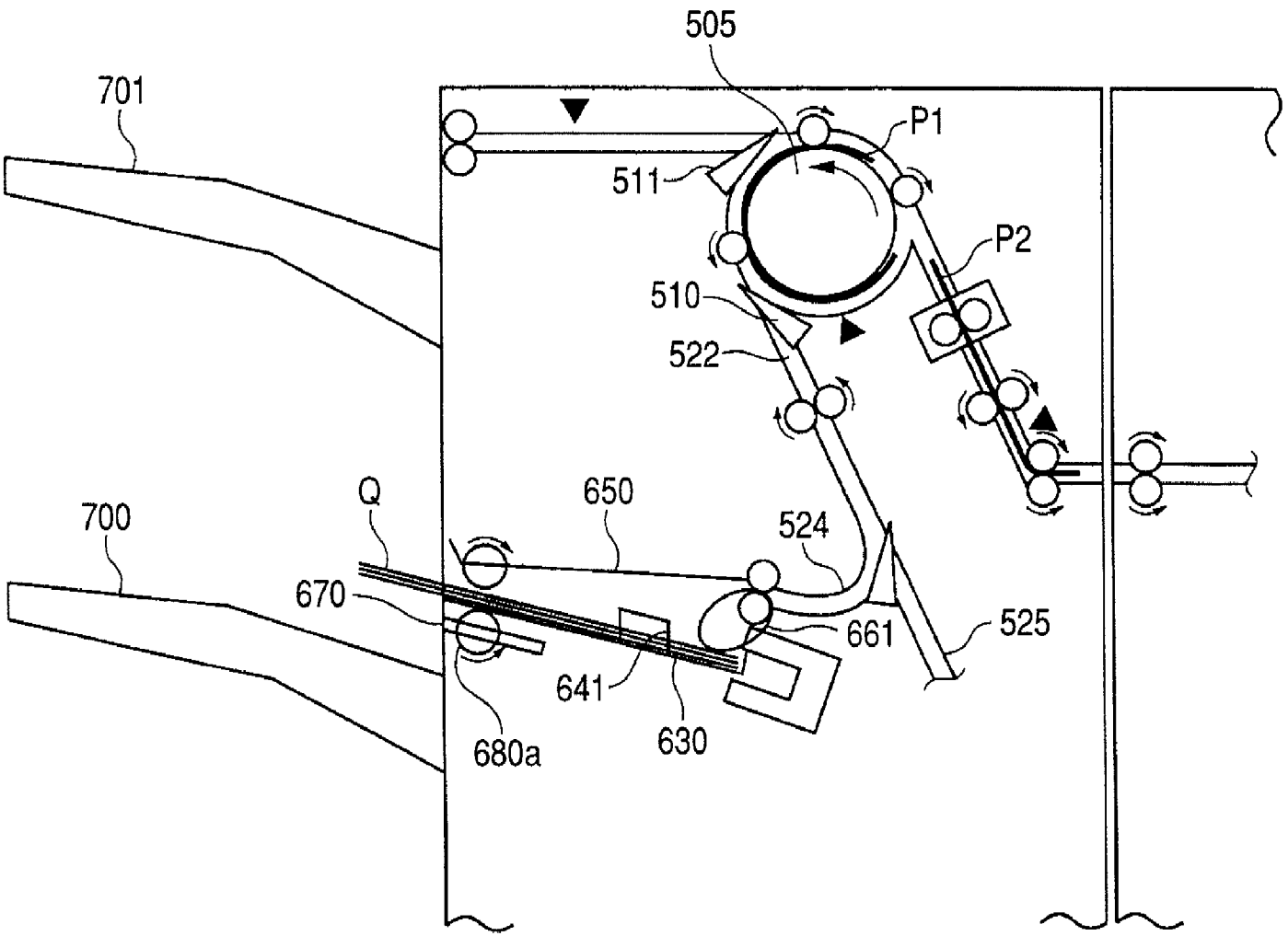
FIG. 11 is a diagram showing the passage of a sheet contained in the finisher in the sort mode.

After that, the above-mentioned sheet bundle delivery process is performed, a sheet bundle Q is delivered onto the stack tray 700 as shown in FIG. 11, and then, each sheet bundle Q is stacked by being alternately off-set. Each sheet bundle is obtained by facing the image forming surface downward, placing the top page at a lowermost position, and by stacking sheets upward in the page order.

Hereinafter, the delivery process of the sheet bundle in the sort mode will be described.

Figure 12:
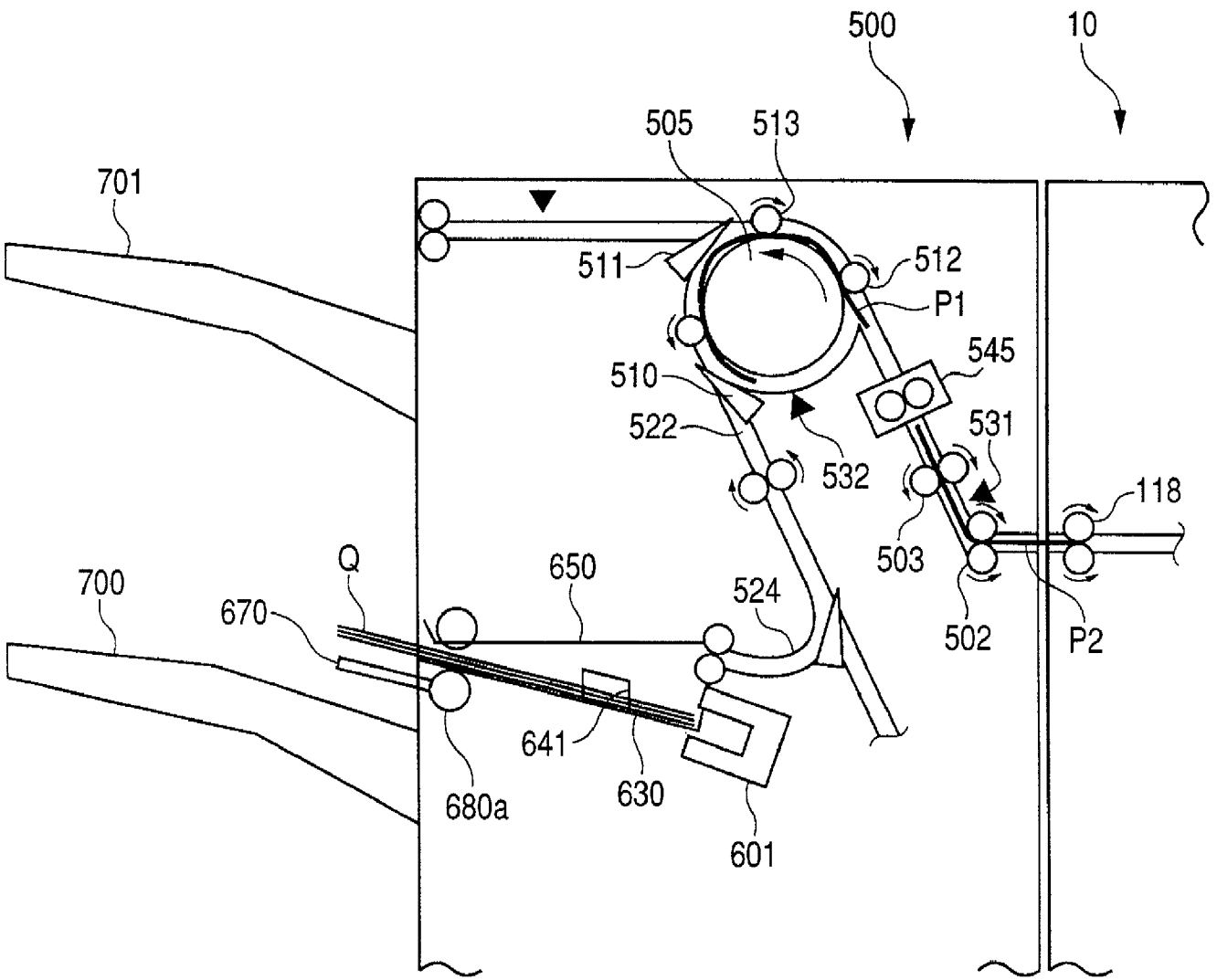
FIG. 12 is a diagram showing a delivery process of a sheet bundle in the sort mode.
Figure 13:
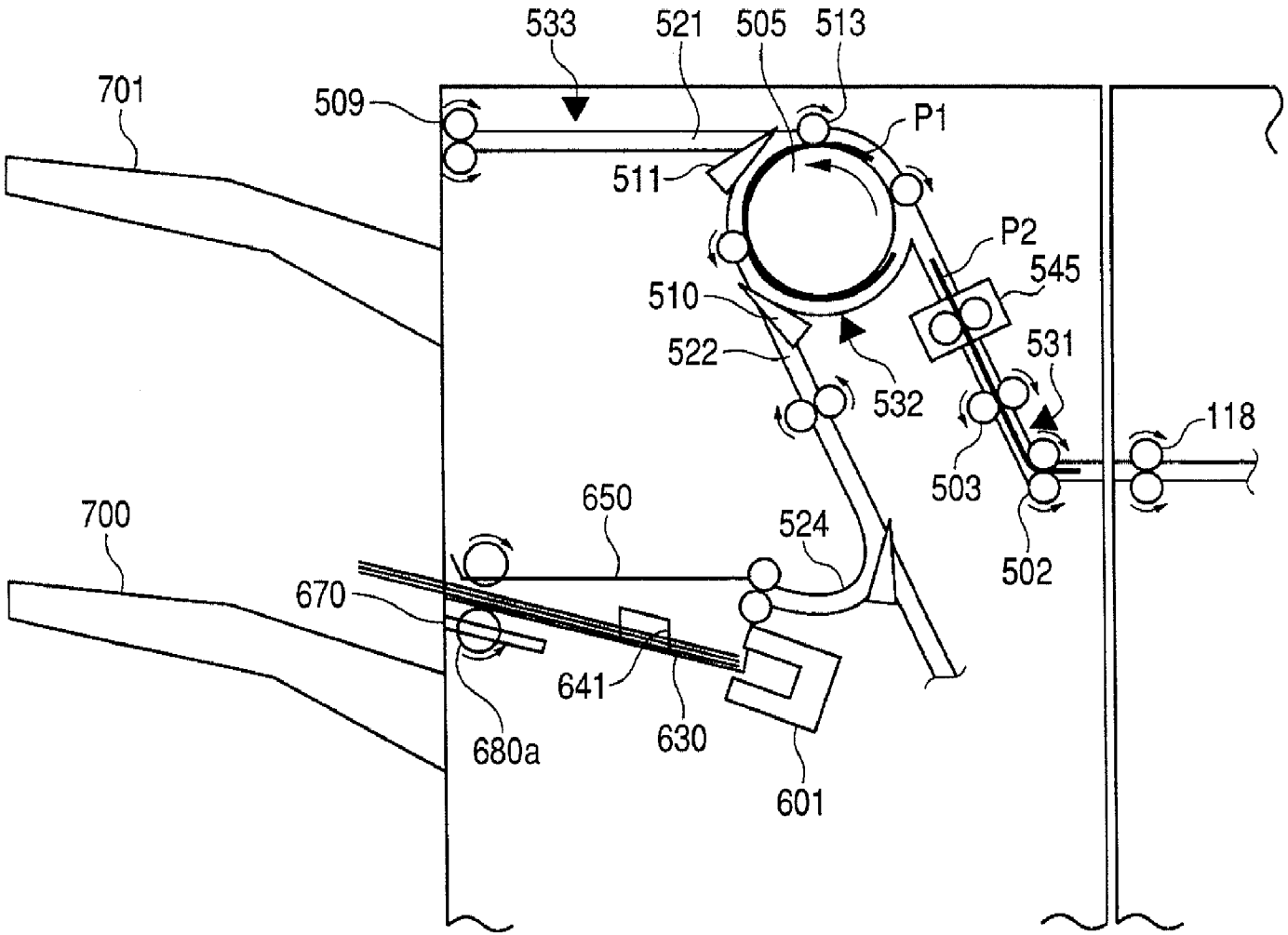
FIG. 13 is a diagram showing the delivery process of a sheet bundle in the sort mode.
Figure 14:
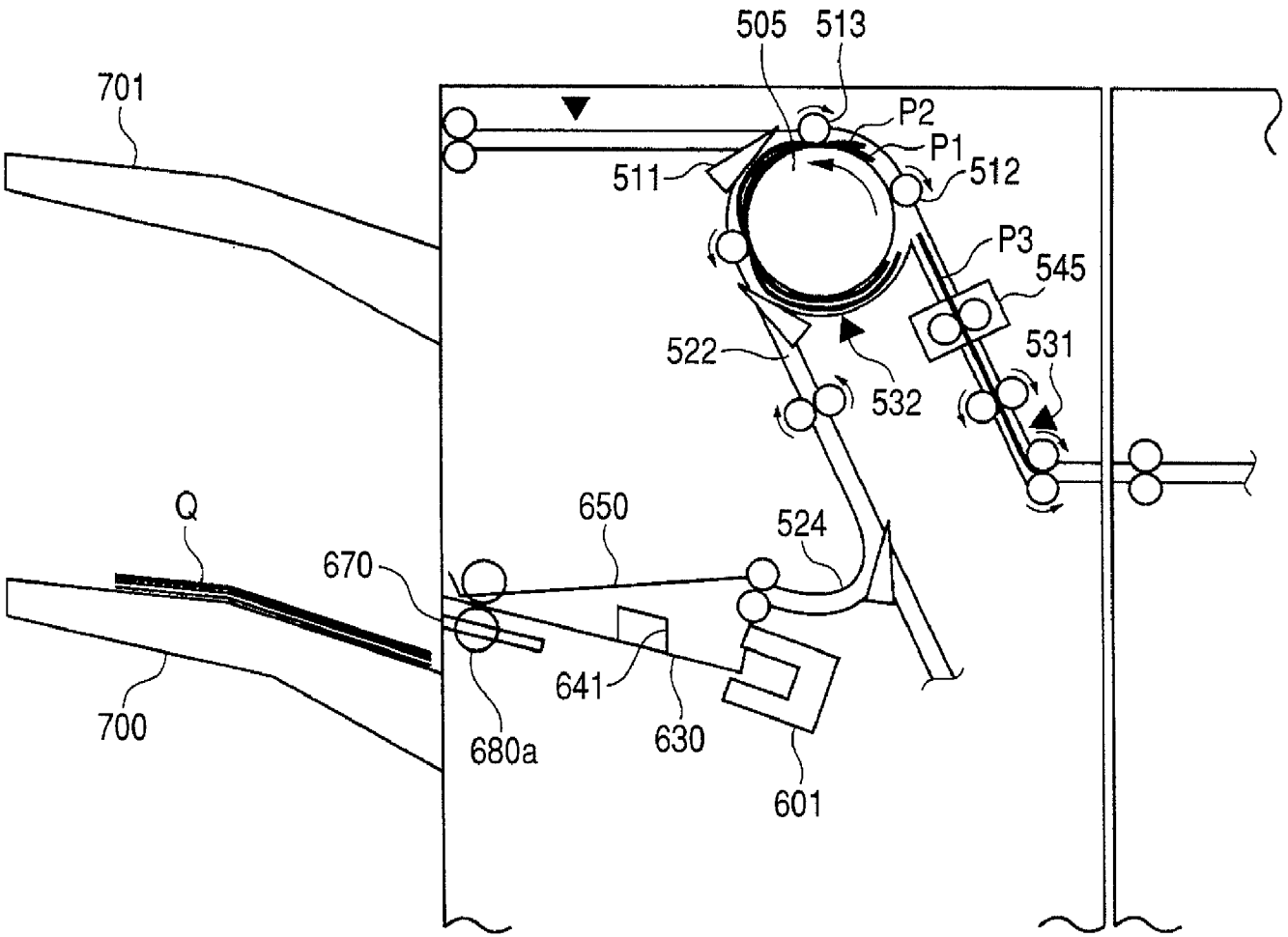
FIG. 14 is a diagram showing the delivery process of a sheet bundle in the sort mode.
Figure 16:
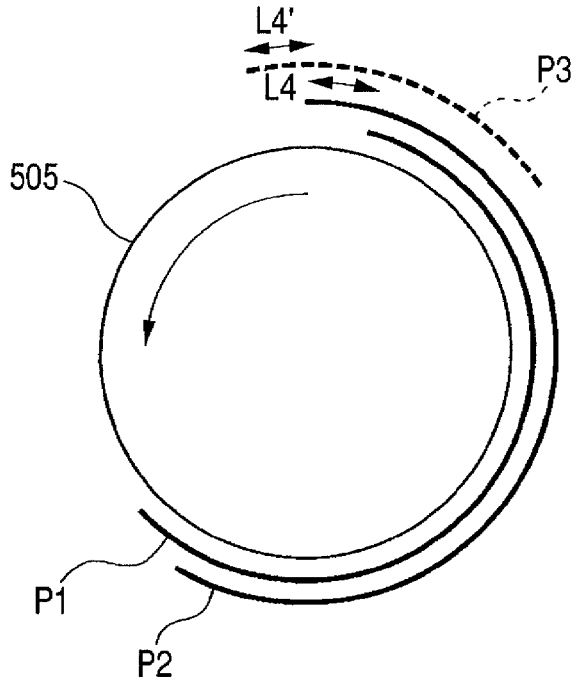
FIG. 16 is a diagram showing a state where sheets are wound around a buffer roller in the sort mode.

The sheet P1 which is a first page of the second set delivered from the image forming apparatus 10 is wound around the buffer roller 505 by the operation of the switching flapper 510 as shown in FIG. 12. The buffer roller 505 is stopped at a position where the sheet P1 is transported from the buffer path sensor 532 by the predetermined distance. When the leading edge of a sheet P2, which is a next page, advances from the entrance sensor 531 by the predetermined distance, the buffer roller 505 starts rotating as shown in FIG. 13. Then, the next sheet P2 overlaps the sheet P1 so that the sheet P2 is ahead of the sheet P1 by the predetermined distance in the sheet transport direction. Here, as shown in FIGS. 14 and 16, the sheet P2 overlaps the sheet P1 so that the sheet P2 is shifted to be ahead of the sheet P1 by the predetermined distance L4 in the sheet transport direction, and is delivered into the buffer path 532 again. Then, a subsequent sheet P3 overlaps the sheet P2 so that the sheet P3 is shifted to be ahead of the sheet P2 by the predetermined distance L4' in the sheet transport direction. The CPU 550 adjusts the timing for rotating the transport motor M4 for driving the transport roller pair 503 according to the rotational speed of the buffer motor M2 for driving the buffer roller 505, thereby executing such the overlapping of sheets. It is possible to separately adjust the deviation amount L4 generated between the sheet P1 and the sheet P2, and the deviation amount L4' generated between the sheet P2 and the sheet P3.

Figure 15:
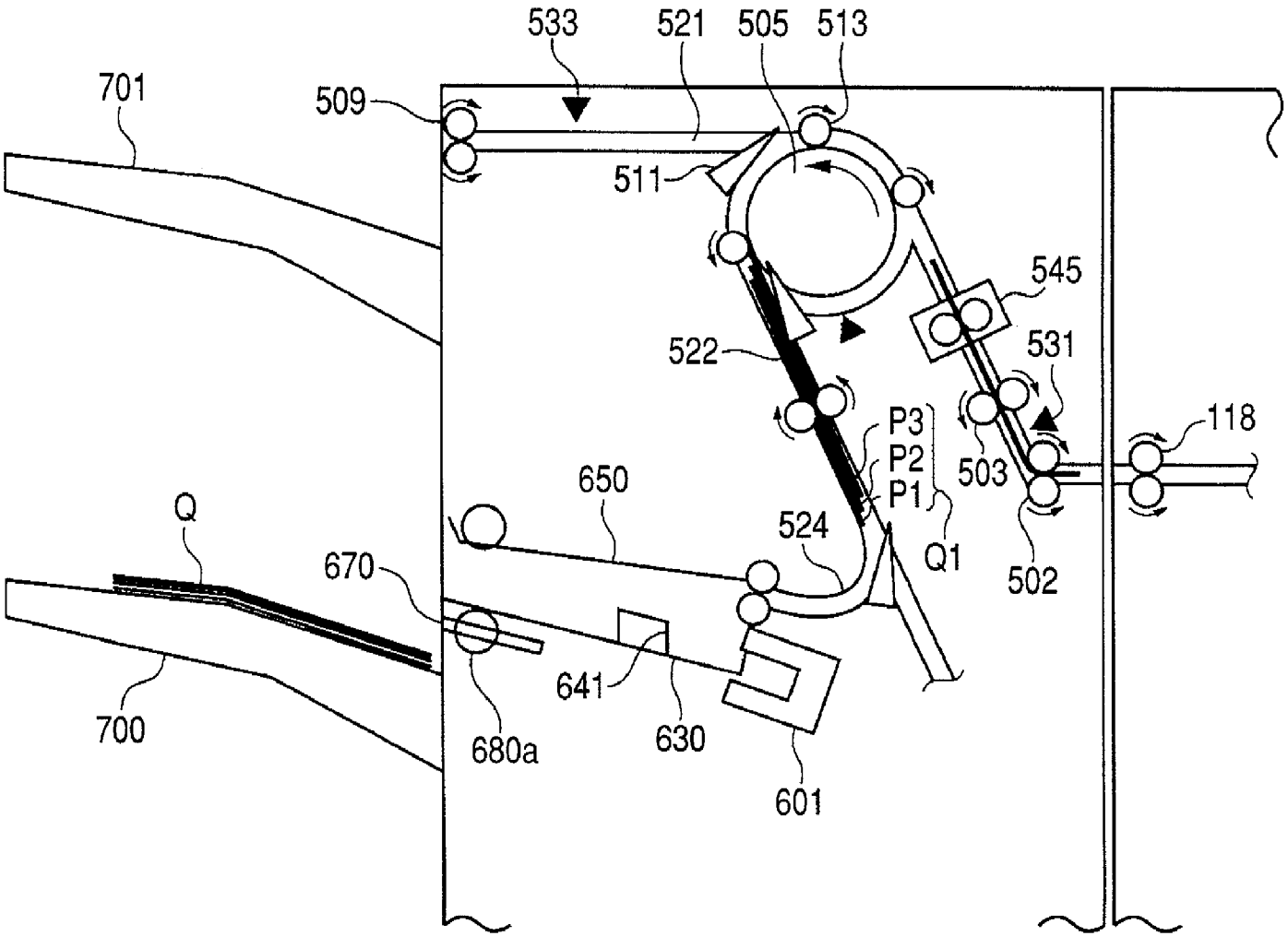
FIG. 15 is a diagram showing the delivery process of a sheet bundle in the sort mode.

The sheets P1, P2, and P3 that are wound around the buffer roller 505 are transported into the sort path 522 as a bundle Q1 constituted by three sheets by the switching flapper 510 as shown in FIG. 15. At this point of time, the delivery process of the sheet bundle Q stacked on the process tray 630 has been completed.

Figure 18:
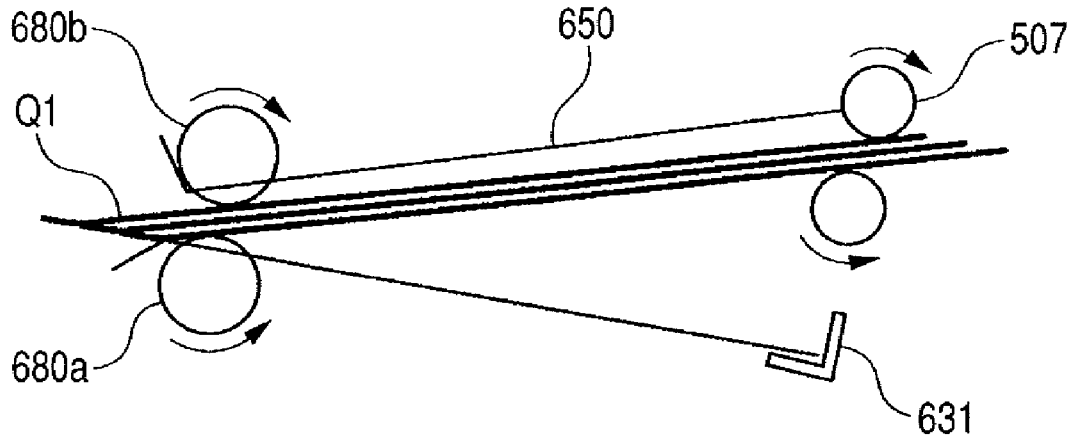
FIG. 18 is a diagram for explaining a process of delivering a sheet bundle to the process tray.

Next, as shown in FIG. 18, the swing guide 650 is maintained to be descended, and the sheet bundle Q1 is drawn in between the delivery rollers 680*a* and 680*b*.

Figure 19:
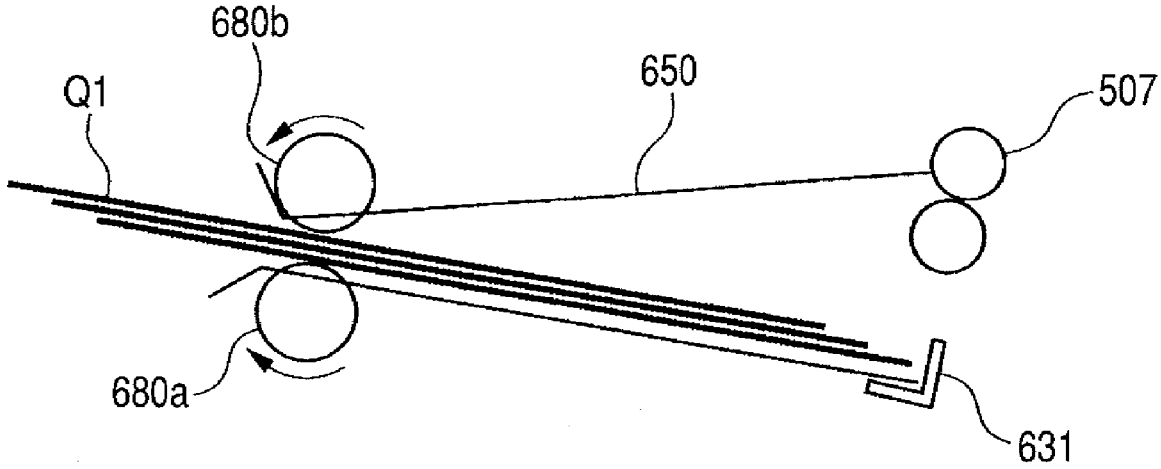
FIG. 19 is a diagram for explaining the process of delivering the sheet bundle to the process tray.
Figure 20:
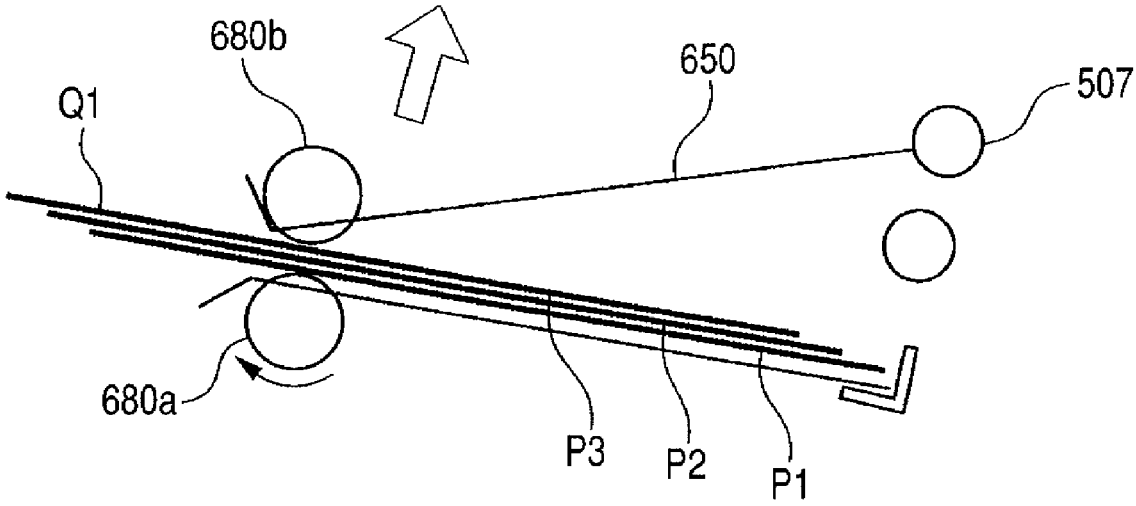
FIG. 20 is a diagram for explaining the process of delivering the sheet bundle to the process tray.
Figure 21:
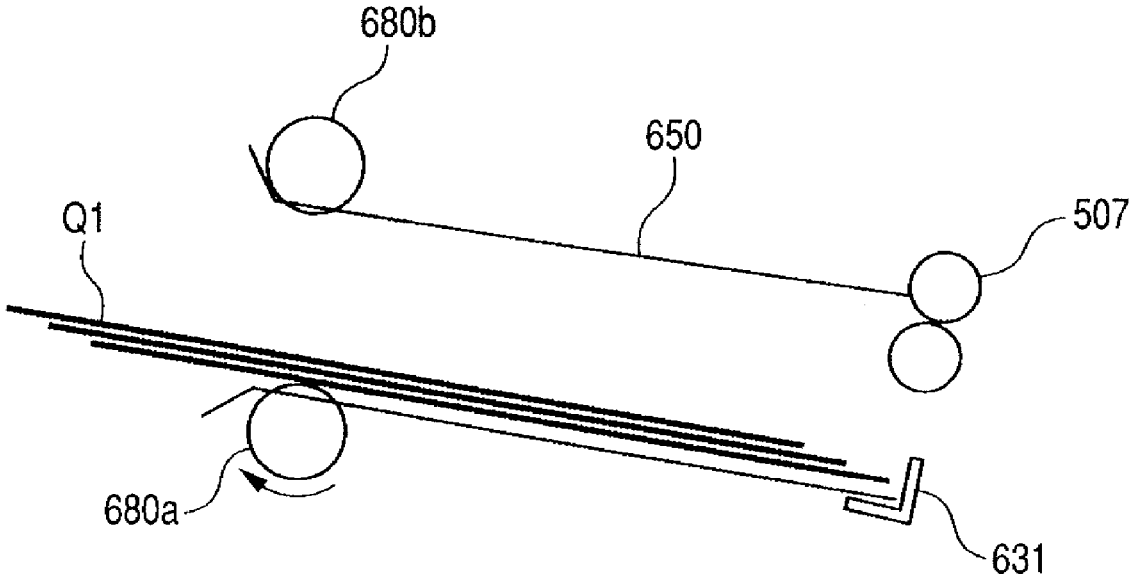
FIG. 21 is a diagram for explaining the process of delivering the sheet bundle to the process tray.

Subsequently, as shown in FIG. 19, when the trailing edge of the sheet bundle Q1 passes through the transport roller pair 507 to be landed on the process tray 630, the delivery rollers 680*a* and 680*b* are reversely rotated, thereby moving the sheet bundle Q1 toward the stoppers 631. Before the trailing edge of the sheet bundle Q1 abuts against the stoppers 631, the swing guide 650 ascends and the delivery roller 680*b* is separated from the sheet P3, as shown in FIG. 20. With regard to the delivery of the sheet bundle Q1 constituted by a plurality of sheets, the sheets are off-set in the transport direction, that is, the sheets each have the deviation amount, as shown in FIG. 21. The sheet P3 is off-set (i.e., has the deviation amount) with respect to the sheet P2, and the sheet P2 is off-set with respect to the sheet P1, to a side opposite to the stopper 631 side. As a result, the sheets P1, P2, and P3 abut against the stoppers 631 in the stated order by their own weight, thereby making it possible to align the three sheets in the transport direction based on the positions of the stoppers 631.

Sheets P4, P5, and P6 which constitute a sheet bundle Q2 subsequently delivered after the sheet bundle Q1 are delivered onto the process tray 630 through the sort path 522 in a similar manner as in the sheet bundle Q1. With respect to a subsequent sheet bundle Q3, the same process is repeatedly performed after the sheet bundle Q2 is delivered onto the stack tray 700. As a result, a predetermined preset number of sheet bundles are stacked on the stack tray 700.

In this embodiment, three sheets overlap one another. However, it is also possible to cause two sheets or four or more sheets to overlap each other.

Next, a delivery process of the first bundle of the first set in the binding mode will be described with reference to FIGS. 22 to 25.

When the binding mode is designated, the entrance roller pair 502, the transport roller pair 503, and the buffer roller 505 are rotationally driven, thereby taking the sheet P delivered from the image forming apparatus 10 into the finisher 500.

Figure 22:
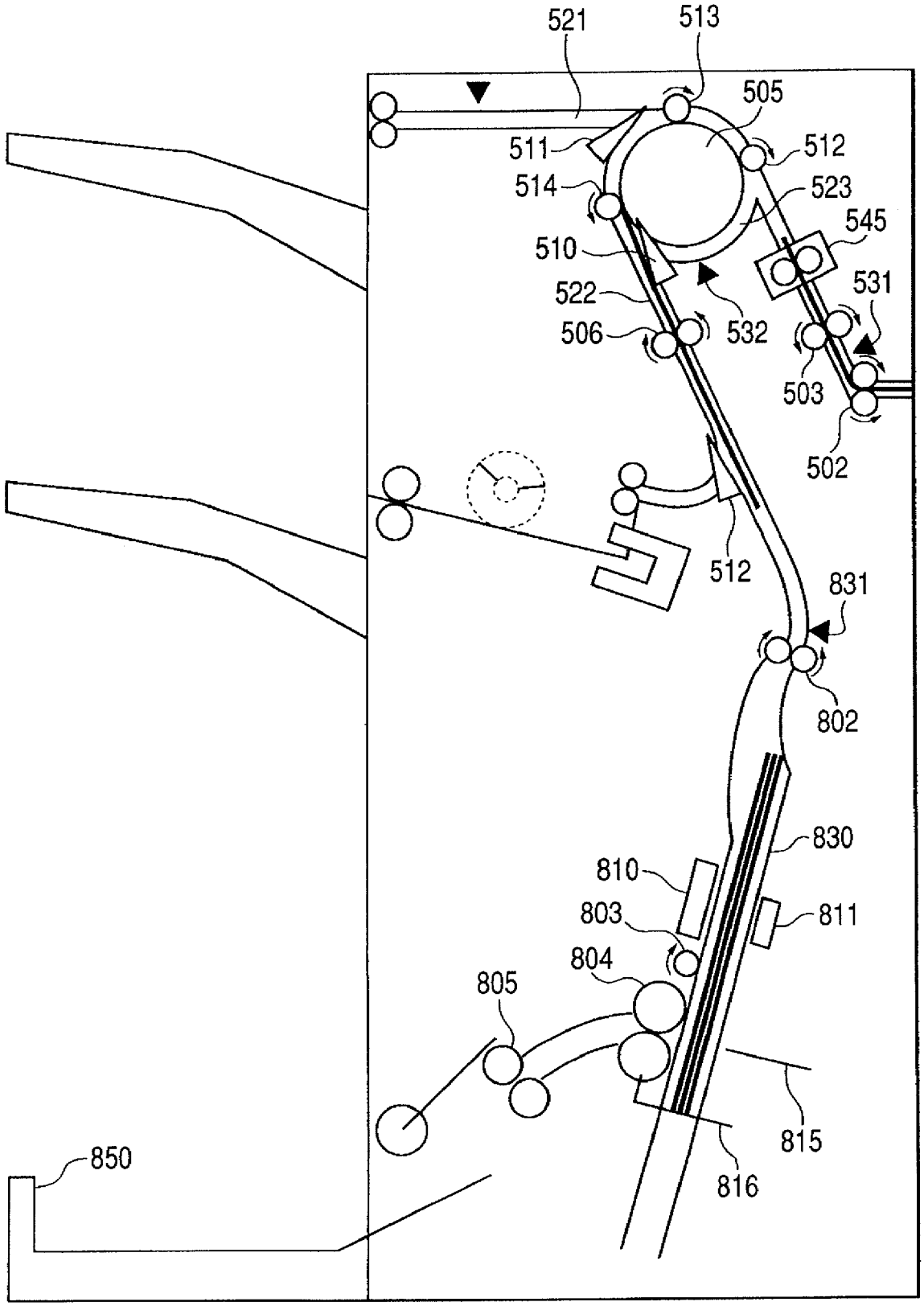
FIG. 22 is a diagram showing a delivery process of a first set contained in the finisher in the binding mode.

The switching flappers 510, 511, and 512 are stopped at the positions indicated in FIG. 22, the sheet P is guided into the binding path 525 from the sort path 522, and then the sheet P is received in the binding process tray 830 by the transport roller pair 802.

The CPU 550 rotationally drives the intermediate roller 803, with the result that the leading edge of the sheet P received in the binding process tray 830 is transported to be brought into contact with the sheet positioning member 816. In this case, the sheet positioning member 816 is placed at a position where a middle part of the contained sheet bundle is subjected to the staple process by the staplers 810.

When the leading edge of the sheet reaches the sheet positioning member 816 and transport of the sheet is stopped, an alignment member (not shown) operates in a direction perpendicular to the sheet transport direction to thereby perform the sheet alignment. When the predetermined number of sheets are aligned to be received in the binding process tray 830, the middle part of the sheet bundle is subjected to the staple process by the staplers 810 as described above.

Figure 23:
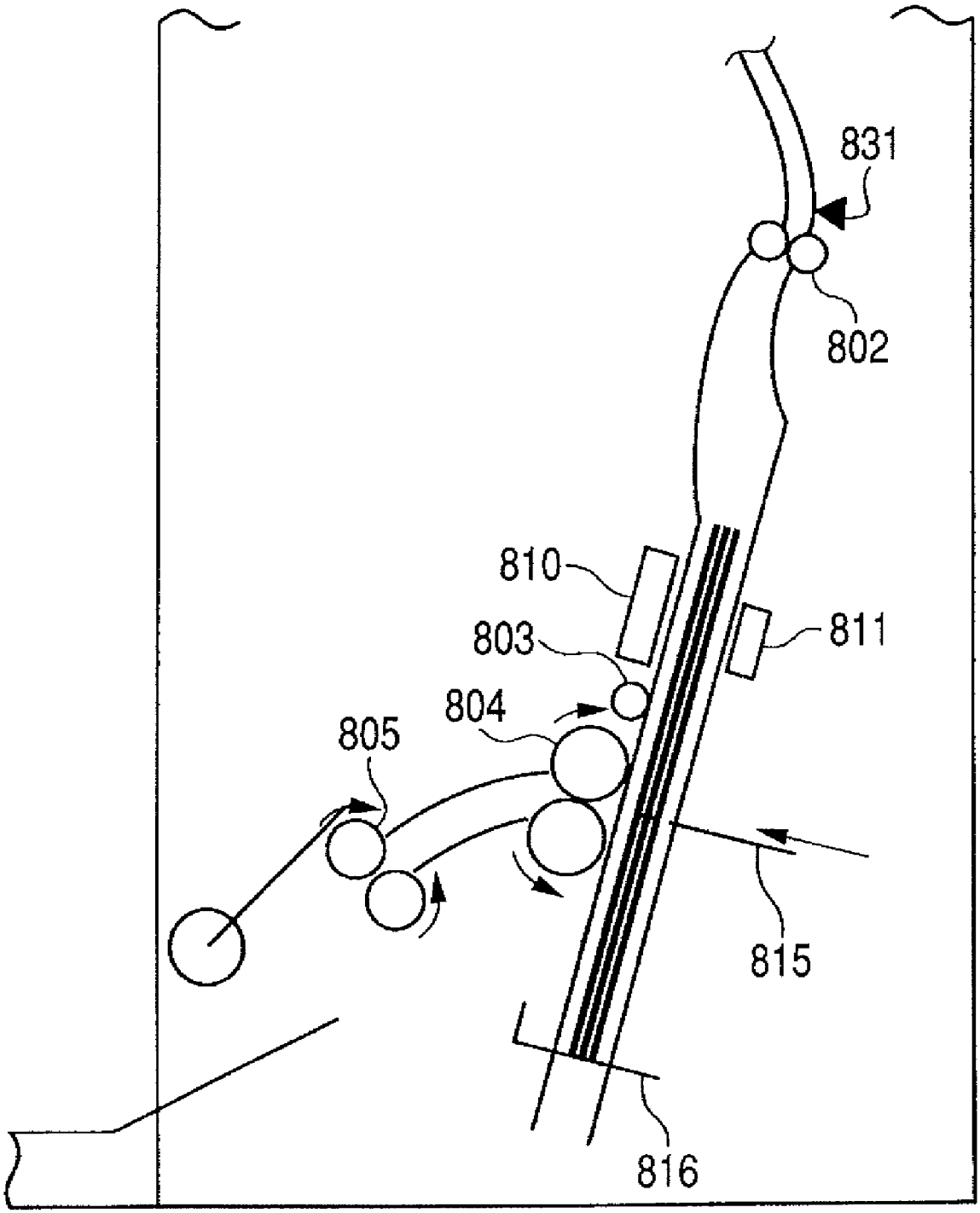
FIG. 23 is a diagram showing the delivery process of the first set contained in the finisher in the binding mode.
Figure 24:
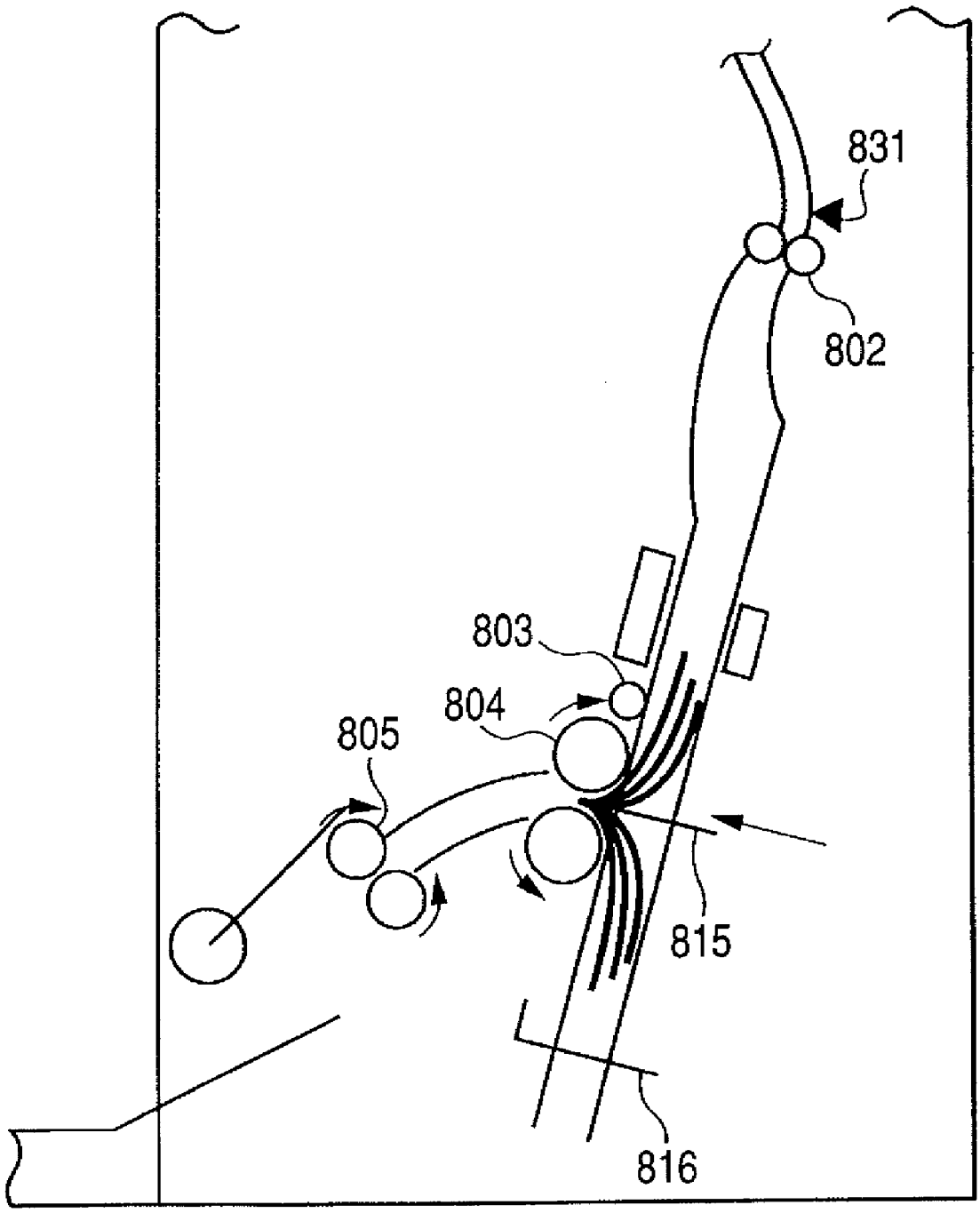
FIG. 24 is a diagram showing the delivery process of the first set contained in the finisher in the binding mode.
Figure 25:
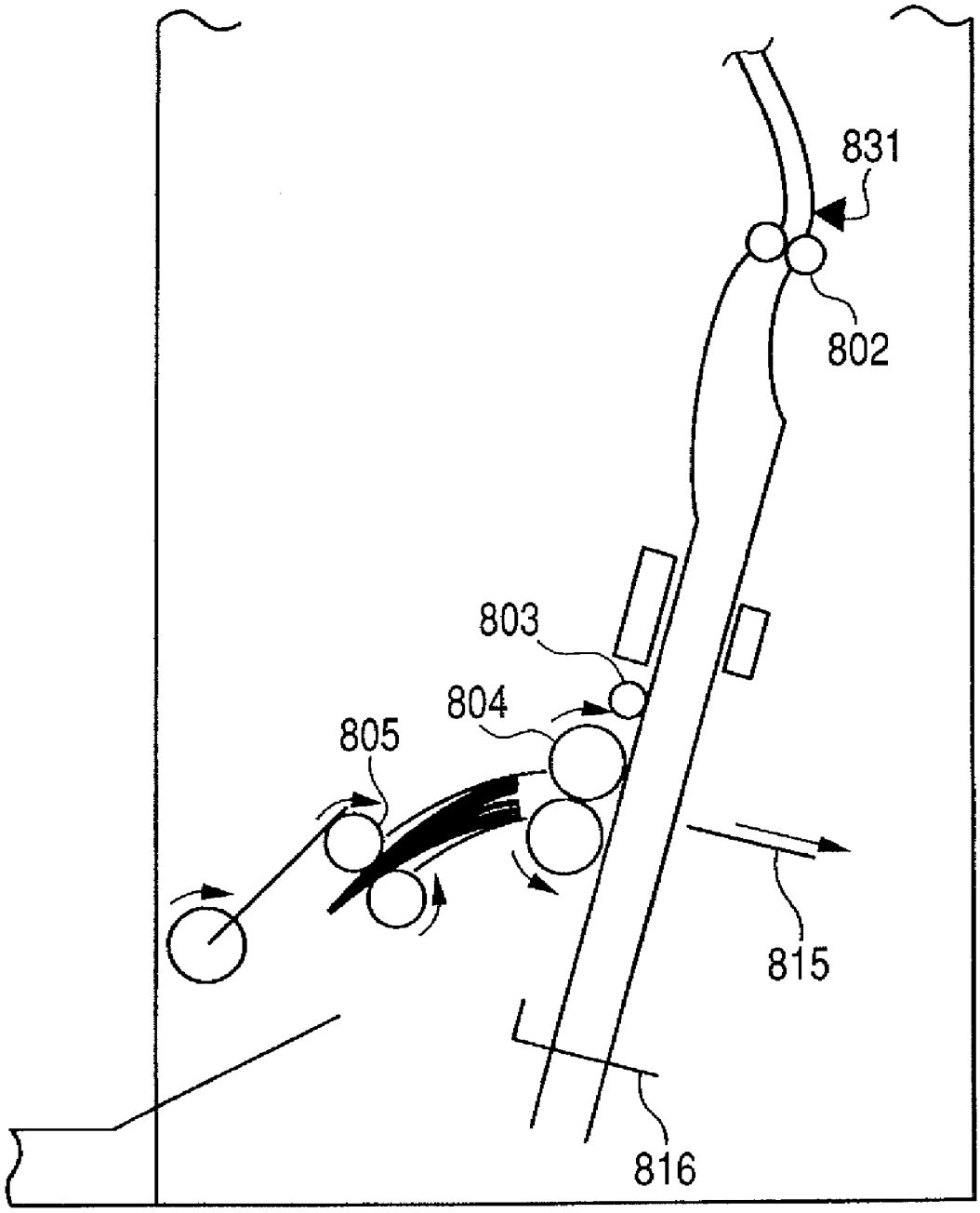
FIG. 25 is a diagram showing the delivery process of the first set contained in the finisher in the binding mode.

As shown in FIGS. 23 and 24, the sheet positioning member 816 is allowed to descend to a position where the staple position (i.e., middle part of the sheet) becomes a middle position of the fold roller pair 804. Then, the fold roller pair 804 and the transport roller pair 805 are rotationally driven, and at the same time, the protruding member 815 is allowed to protrude to push out the sheet bundle between the fold roller pair 804. As shown in FIG. 25, the sheet bundle is transported while being folded between the fold roller pair 804, delivered to the delivery tray 850 by the transport roller pair 805, and then stacked thereon.

Hereinafter, a delivery process of the second set of sheet bundle in the binding mode will be described.

Figure 17:
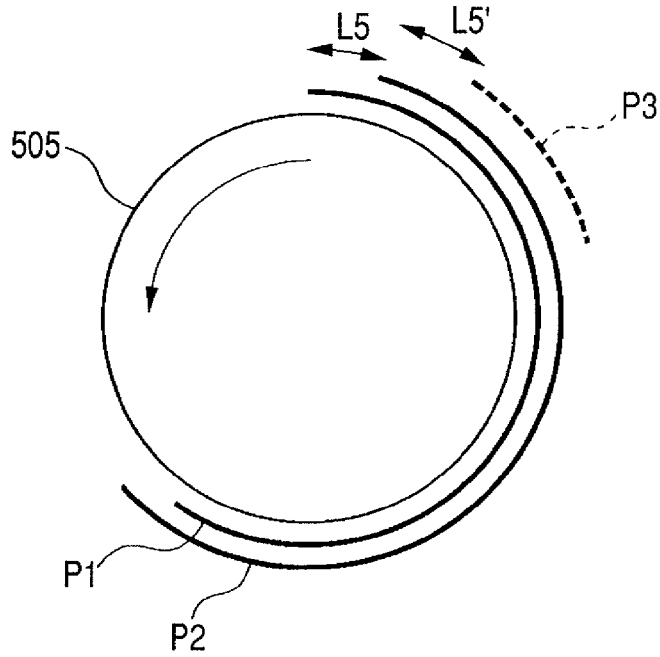
FIG. 17 is a diagram showing a state where sheets are wound around a buffer roller in a binding mode.
Figure 26:
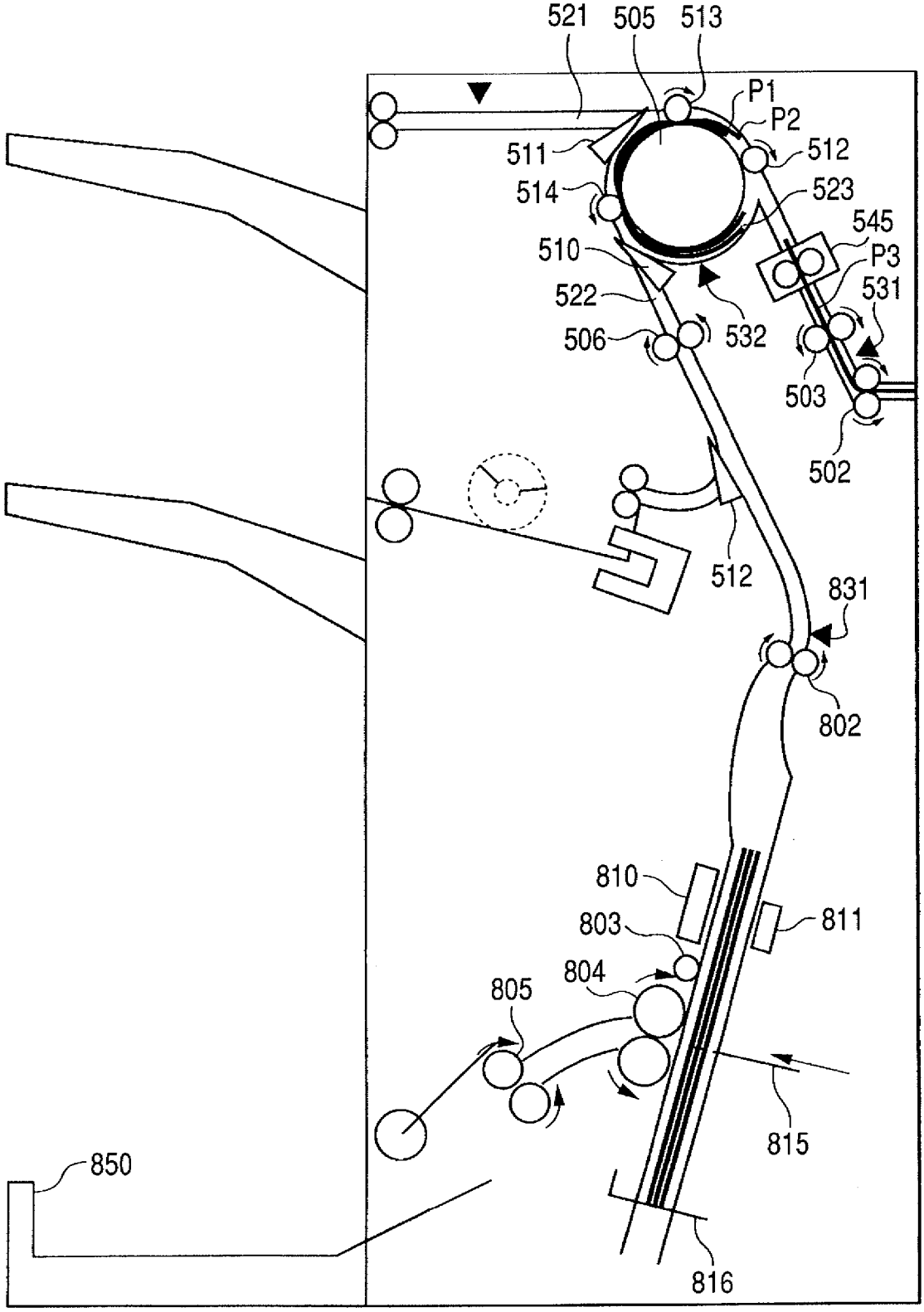
FIG. 26 is a diagram showing a delivery process of a second set contained in the finisher in the binding mode.
Figure 27:
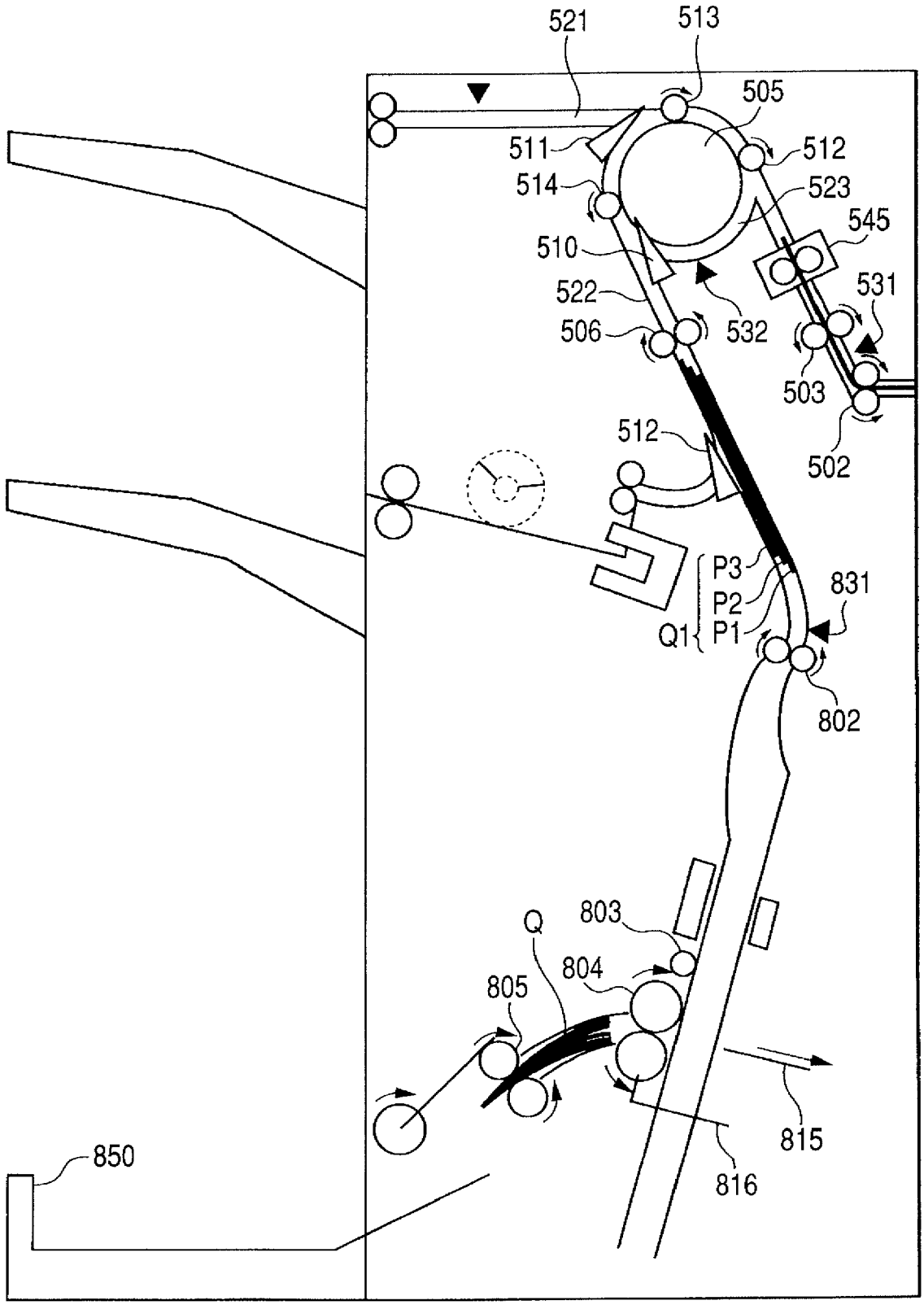
FIG. 27 is a diagram showing the delivery process of the second set contained in the finisher in the binding mode.

The sheet P1 which is the first page of the second set delivered from the image forming apparatus 10 is wound around the buffer roller 505 by the operation of the switching flapper 510 in a similar manner as in the second set in the sort mode. The buffer roller 505 is stopped at a position where the sheet P1 is transported by the predetermined distance from the buffer path sensor 532. When the leading edge of the sheet P2, which is the next page of the second set, advances by the predetermined distance, the buffer roller 505 starts rotating. As a result, the sheet P2 overlaps the sheet P1 so that the sheet P2 is behind of the sheet P1 in the sheet transport direction by the predetermined distance. Herein, as shown in FIGS. 26 and 17, the sheet P2 overlaps the sheet P1 so that the sheet P2 is behind of the sheet P1 in the sheet transport direction by a predetermined distance L5. Further, the sheet P3 overlaps the sheet P2 so that the sheet P3 is shifted by a predetermined distance L5' to follow the sheet P2 in the sheet transport direction. The offset value (i.e., deviation amount) between the sheets becomes contrary to that in the case of the above-mentioned sort mode. The CPU 550 adjusts the timing for rotating the transport motor M4 for driving the transport roller pair 503 according to the rotational speed of the buffer motor M2 for driving the buffer roller 505, thereby executing such the overlapping of the sheets. The deviation amount L5 between the sheet P1 and the sheet P2, and the deviation amount L5' between the sheet P2 and the sheet P3 can be separately adjusted.

The sheets P1, P2, and P3 which are wound around the buffer roller 505 are transported into the sort path 522 by the switching flapper 510 as the sheet bundle Q1 constituted of three sheets. At this point of time, a folding operation of the sheet bundle Q received in the binding process tray 830 has been completed. In addition, the sheet positioning member 816 is moved from a position for the folding process with respect to the previous sheet stack Q, to a position for the staple process with respect to the subsequent sheet bundle Q1. As a result, the sheet bundle Q1 is in a state capable of being received in the binding process tray 830 by the transport roller pair 802 and the intermediate roller 803.

Figure 28:
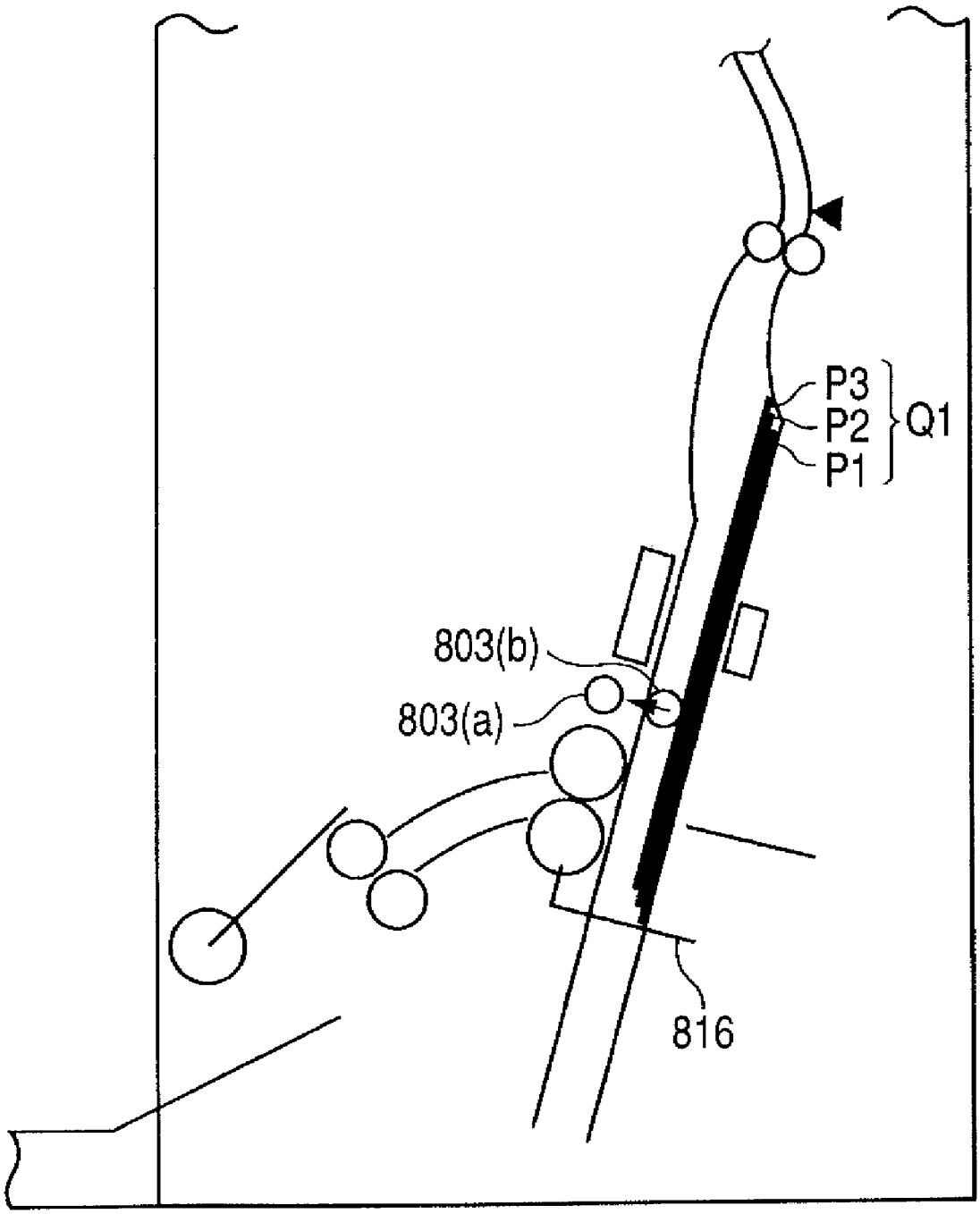
FIG. 28 is a diagram showing a state where an intermediate roller is allowed to move.

Then, as shown in FIG. 28, it is possible to dispose the intermediate roller 803 by switching the position of the intermediate roller 803 between a position 803(*b*) and a position 803(*a*) by causing a current to flow through a solenoid (not shown) under control of the CPU 550. At the position 803(*b*), the sheet is transported by bringing the intermediate roller 803 into contact with the sheet received in the binding process tray 830, and at the position 803(*a*), the sheet is transported without bringing the intermediate roller 803 into contact with the sheet received in the binding process tray 830.

When the trailing edge of the sheet bundle P passes through the transport roller pair 802, the intermediate roller 803 is moved to the position 803(*b*) from the position 803(*a*) to transport the sheet, thereby transporting the sheet bundle Q1 downstream. Then, the leading edge of the sheet bundle Q1 abuts against the sheet positioning member 816 after the intermediate roller 803 is moved to the position 803(*a*).

In this case, the sheet P3 is off-set (i.e., has the deviation amount) with respect to the sheet P2, and the sheet P2 is off-set with respect to the sheet P1, to a side opposite to the sheet positioning member 816 side.

Thus, the sheets P1, P2, and P3 abut against the sheet positioning member 816 in the stated order by their own weight, thereby making it possible to align the three sheets in the transport direction based on the position of the sheet positioning member 816.

The sheets P4, P5, and P6 which constitute a sheet bundle Q2 delivered after the sheet bundle Q1 are delivered onto the binding process tray 830 through the sort path 522 in a similar manner as in the sheet bundle Q1. With respect to a next sheet bundle Q3, the same process is repeatedly performed after the sheet bundle Q2 is delivered onto the delivery tray 850. As a result, a predetermined preset number of sheet bundles are stacked on the delivery tray 850.

In this embodiment, three sheets overlap one another. However, it is also possible to cause two sheets or four or more sheets to overlap each other.

Figure 29:
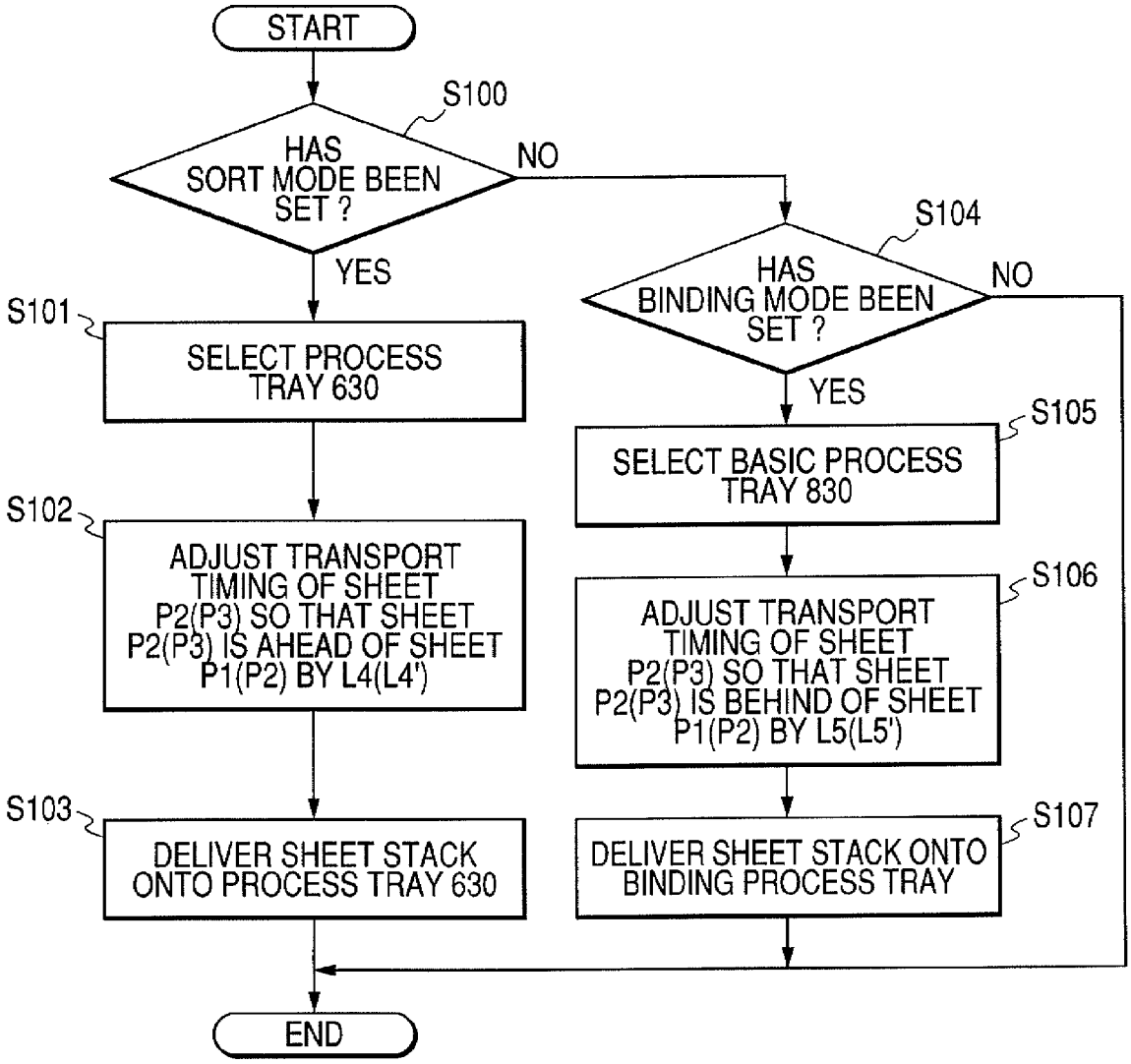
FIG. 29 is a flowchart showing a process executed by a CPU provided in the finisher when a sheet bundle is outputted to the process tray or a binding process tray.

FIG. 29 is a flowchart showing a process executed by the CPU 550 when the sheet bundle is outputted to the process tray 630 or the binding process tray 830.

Figure 30:
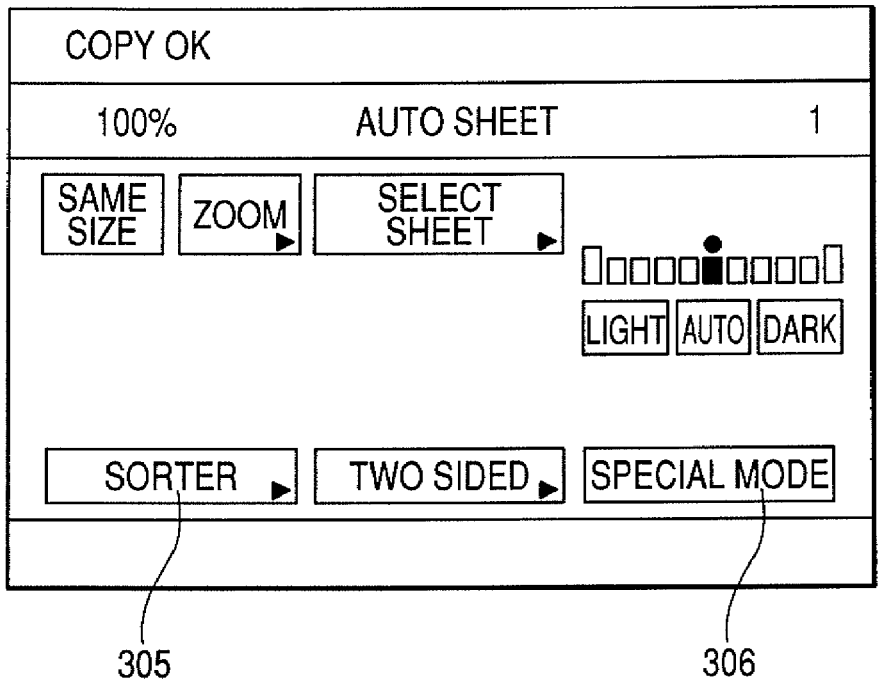
FIG. 30 is a diagram showing an example of an operation screen which is displayed on a display part.
Figure 31:
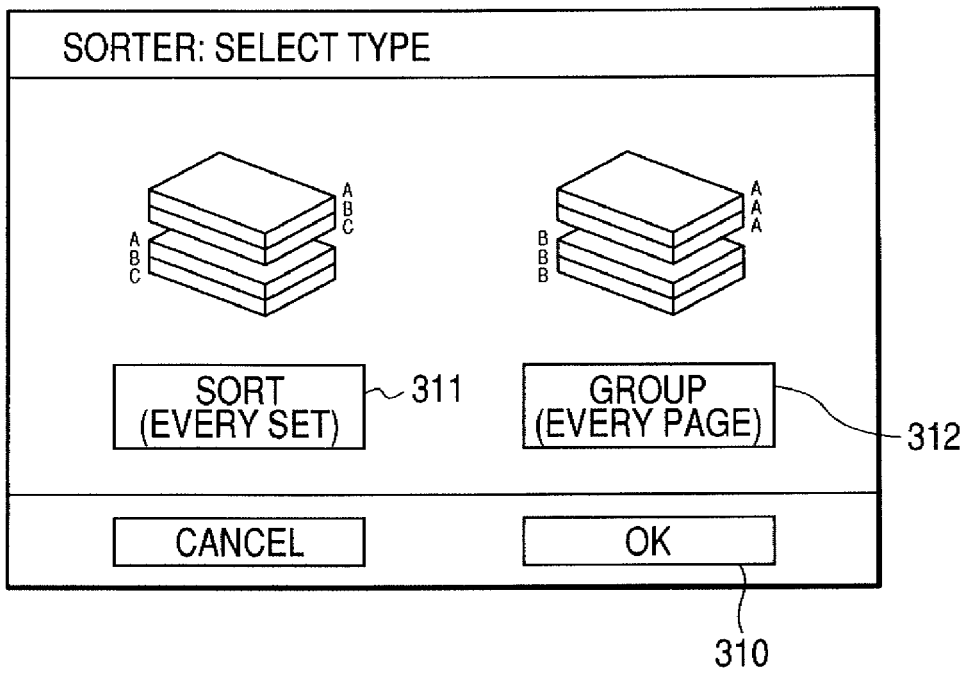
FIG. 31 is a diagram showing an example of a selection screen for selecting a type of sort which is displayed on the display part.
Figure 32:
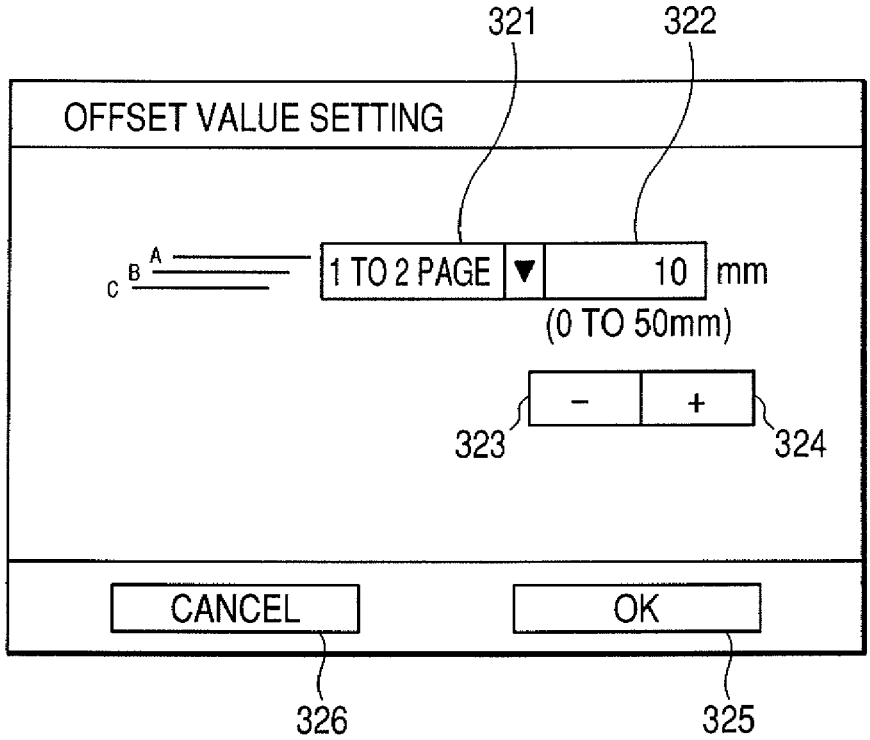
FIG. 32 is a diagram showing an example of a setting screen of an offset value which is displayed on the display part.

First, the CPU 550 determines whether or not the sort mode has been set (Step S100). On a display part of the operation display device 400, an operation screen shown in FIG. 30 is displayed. In this case, when a button 305 of a sorter shown in FIG. 30 is pressed down, a selection screen shown in FIG. 31 for selecting a type of sort is displayed on the display part. Further, when one of a button 311 for designating a sort for every set, and a button 312 for designating a sort for every page is pressed down, and an OK button 310 is pressed down, an offset value setting screen shown in FIG. 32 is displayed on the display part. On the offset value setting screen, a pull-down portion 321 for designating which sheets the offset value is to be set between, an entry field 322 for inputting an offset value, a minus button 323 for decreasing the offset value, a plus button 324 for increasing the offset value, an OK button 325, and a cancel button 326 are displayed. An initial value of the offset value is set to 10 mm, which can be changed in a range of 0 to 50 mm by pressing down the minus and plus buttons 323 and 324. In the pull-down portion 321 shown in FIG. 32, the offset value between the first sheet and the second sheet is designated. However, it is also possible to set the offset value of 10 mm uniformly between all the overlapping sheets.

Here, when the OK button 325 shown in FIG. 32 is pressed down, the CPU circuit portion 150 of the image forming apparatus 10 outputs to the CPU 550 of the finisher 500 a signal indicating that a sort mode has been set and a signal indicating the offset value. The CPU 550 receives those signals and selects the process tray 630 from among a plurality of intermediate trays (that is, the process tray 630 and the binding process tray 830) in response to the signal indicating that the sort mode has been set (Step S101).

The process tray 630 includes the stoppers 631 against which the trailing edge of the sheet in the transport direction is allowed to abut. As a result, the CPU 550 adjusts a transport timing of the sheet P2 (or sheet P3) at which the sheet P2 (or sheet P3) overlaps the sheet P1 (or sheet P2) so that the sheet P2 (or sheet P3) is ahead of the sheet P1 (or sheet P2) in the sheet transport direction by the predetermined distance L4 (or L4') (Step S102). To be specific, the CPU 550 outputs a timing adjustment signal to the transport motor M4 in response to the signal indicating the received offset value and in accordance with the rotational speed of the buffer motor M2 for driving the buffer roller 505, thereby rotating the transport motor M4. As a result, the deviation amount between the sheet P1 and the sheet P2 is obtained as L4 and the deviation amount between the sheet P2 and the sheet P3 is obtained as L4' as described above.

After that, the CPU 550 transports the sheet bundle wound around the buffer roller 505 onto the process tray 630 by rotating the transport roller pairs 506 and 507 (Step S103), thereby completing this process.

On the other hand, in Step S100, in a case where the sort mode has not been set, the CPU 550 determines whether or not the binding mode has been set (Step S104).

Figure 33:
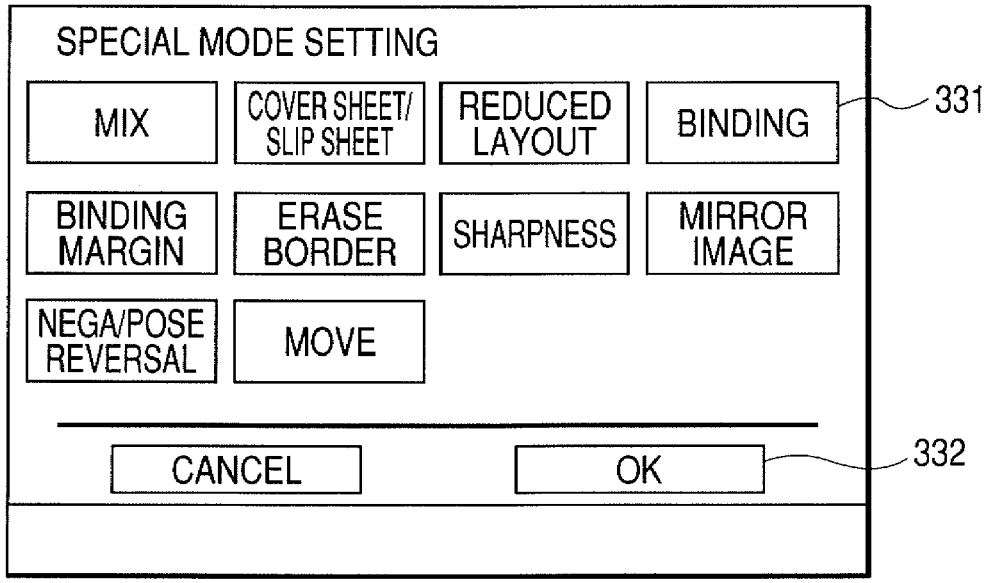
FIG. 33 is a diagram showing an example of a selection screen for selecting a type of a special mode which is displayed on the display part.
Figure 34:
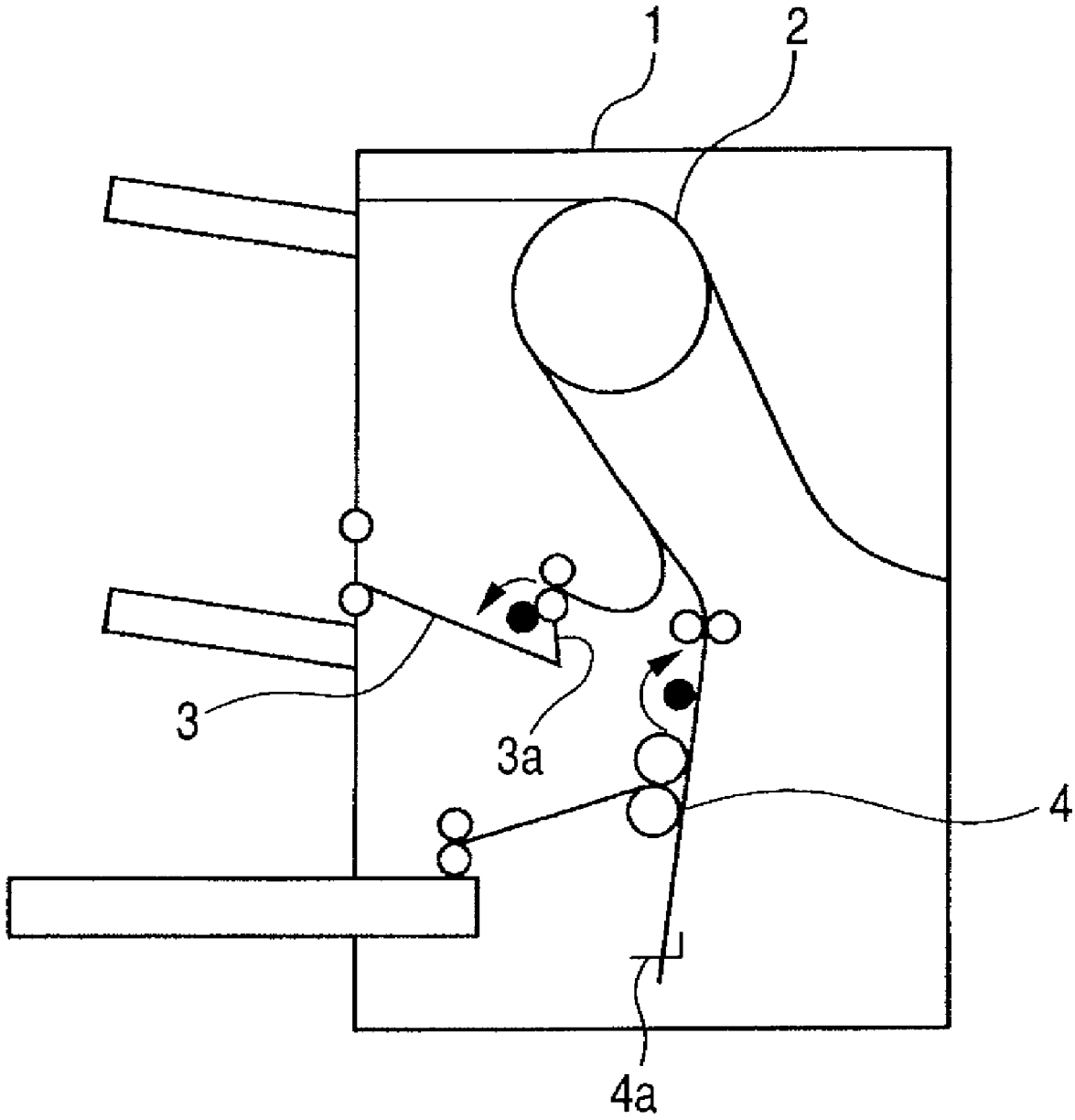
FIG. 34 is a diagram showing a structure of a conventional post-processing apparatus.
Figure 35A:
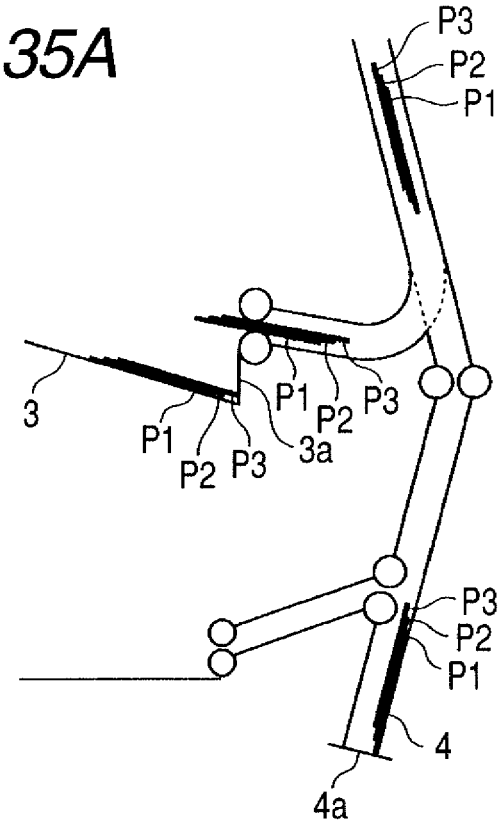
FIG. 35A is a diagram showing a state where a sheet bundle, obtained by causing sheets P1, P2, and P3 to overlap one another so that the sheet P1 is ahead of the sheet P2, and in addition, the sheet P2 is ahead of the sheet P3, is outputted to an intermediate tray.
Figure 35B:
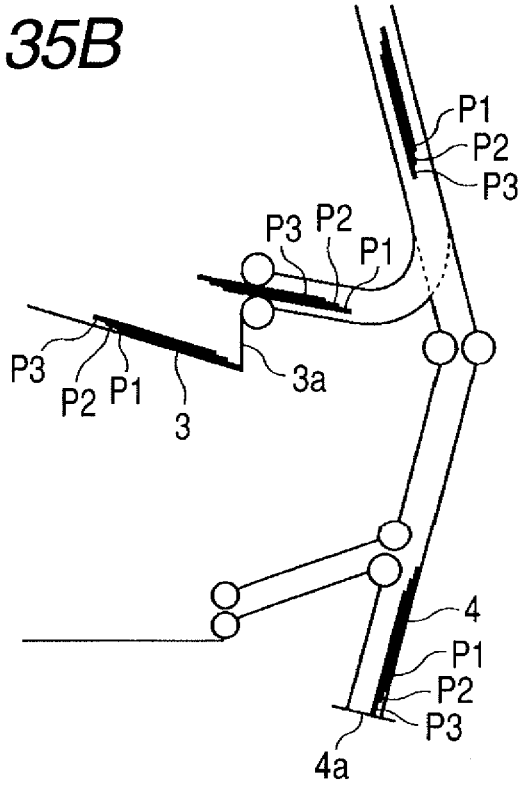
FIG. 35B is a diagram showing a state where a sheet bundle, obtained by causing the sheets P1, P2, and P3 to overlap one another so that the sheet P3 is ahead of the sheet P2, and in addition, the sheet P2 is ahead of the sheet P1, is outputted to an intermediate tray.

When a button 306 for selecting a special mode is pressed down on the operation screen shown in FIG. 30, a selection screen shown in FIG. 33 for selecting a type of the special mode is displayed on the display part. Herein, when a binding button 331 is pressed down and further an OK button 332 is pressed down, the offset value setting screen shown in FIG. 32 is displayed on the display part. The setting screen is structured in the same manner as described above, so the description thereof will be omitted.

Here, when the OK button 325 shown in FIG. 32 is pressed down, the CPU circuit portion 150 of the image forming apparatus 10 outputs to the CPU 550 of the finisher 500 a signal indicating that a binding mode has been set and a signal indicating the offset value. The CPU 550 receives those signals and selects the binding process tray 830 from among the plurality of intermediate trays in response to the signal indicating that the binding mode has been set (Step S105).

The binding process tray 830 includes the sheet positioning member 816 against which the trailing edge of the sheet in the transport direction is allowed to abut. As a result, the CPU 550 adjusts a transport timing of the sheet P2 (or sheet P3) at which the sheet P2 (or sheet P3) overlaps the sheet P1 (or sheet P2) so that the sheet P2 (or sheet P3) is behind of the sheet P1 (or sheet P2) in the sheet transport direction by the predetermined distance L5 (or L5') (Step S106). To be specific, the CPU 550 outputs the timing adjustment signal to the transport motor M4 in response to the signal indicating the received offset value and in accordance with the rotational speed of the buffer motor M2 for driving the buffer roller 505, thereby rotating the transport motor M4. As a result, the deviation amount between the sheet P1 and the sheet P2 is obtained as L5 and the deviation amount between the sheet P2 and the sheet P3 is obtained as L5' as described above.

After that, the CPU 550 transports the sheet bundle wound around the buffer roller 505 onto the binding process tray 830 by switching the flapper 512 to guide the sheet into the binding path 525 and by rotating the transport roller pair 802 (Step S107), thereby completing this process.

In Step S104, in a case where the binding mode has not been set, this process is completed because the intermediate tray is not to be used.

In the above-mentioned Steps S102 and S106, the CPU 550 adjusts a rotation timing of the transport motor M4, that is, a sheet transport timing, in response to the signal indicating the received offset value and in accordance with the rotational speed of the buffer motor M2 for driving the buffer roller 505. Alternatively, the timing adjustment signal may be outputted to the buffer motor M2 in response to the signal indicating the received offset value and in accordance with the rotational speed of the transport motor M4, thereby rotating the transport motor M4. As a result, it is possible to adjust the timing at which the sheet is wound around the buffer roller 505, and to secure the above-mentioned offset value of the sheet.

As described above, according to this embodiment, the sheet transport timing or the sheet overlap timing is controlled as follows. One intermediate tray is selected from among the plurality of intermediate trays (i.e., the process tray 630 and the binding process tray 803), and a sheet to be transported is overlapped with at least one sheet stayed on the buffer roller 505 so that the sheet to be transported is shifted in the sheet transport direction by a predetermined offset value with respect to the at least one stayed sheet, according to the selected intermediate tray. Accordingly, it is possible to execute the sheet alignment in the sheet transport direction with high accuracy. In addition, since one buffer roller 505 is shared with the plurality of intermediate trays, it is possible to prevent the size and manufacturing cost of the finisher 500 from increasing.

Further, according to the stopper or the positioning member provided to the selected intermediate tray, the sheet transport timing or the sheet overlap timing is controlled, in other words, an offset direction of the sheet is determined, thereby making it possible to execute the sheet alignment in the sheet transport direction with high accuracy.

It should be noted that, in this embodiment, the selection and setting of the sort mode or the binding mode are performed on the operation display device 400 of the image forming apparatus 10. However, the selection and setting of the sort mode or the binding mode may be executed by providing an operation display device to the finisher 500. In such the case, the CPU 550 inputs from the operation display device of the finisher 500 a signal indicating that the sort mode has been set, a signal indicating that the binding mode has been set, or a signal indicating the offset value.

Further, the object of the present invention can also be attained in a case where a storage medium which stores a program code of software for realizing functions of the embodiment is supplied to a system or an apparatus, and a computer (e.g., a CPU or an MPU) of the system or the apparatus reads and executes the program code stored in the storage medium.

In this case, the program code itself which is read from the storage medium realizes the functions of the embodiment, and the program code and the storage medium storing the program code constitute the present invention.

For the storage medium for supplying the program code, for example, a floppy (registered trademark) disk, a hard disk, a magnetic optical disk, a CD-ROM, a CD-R, a CD-RW, a DVD-ROM, a DVD-RAM, a DVD-RW, a DVD+RW, a magnetic tape, a nonvolatile memory card, a ROM, and the like may be used. Alternatively, the program code may be downloaded via a network.

Further, the functions of the embodiment are not only realized by executing the program code read from the computer, but also may be realized by the process in which an operating system (OS) or the like which operates on the computer carries out a part of or the whole of the actual process in response to the instruction of the program code.

Further, the above-mentioned functions of the embodiment may also be realized by the process in which the program code read from the storage medium is written in a memory which is provided to a function expanding board inserted into the computer or a function expanding unit connected to the computer, and then a CPU or the like which is provided to the function expanding board or the function expanding unit carries out a part of or the whole of the actual process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-252338, filed Aug. 31, 2005, which is hereby incorporated by reference herein in its entirety.

What is claimed is:

1. A post-processing apparatus which sequentially receives sheets one by one from an image forming apparatus to execute a post-process on the sheets, comprising:

a first transport device which receives sheets delivered from the image forming apparatus and transports the sheets;

a sheet overlap device which stays the sheets transported by the first transport device and causes another sheet transported sequentially by the first transport device, to overlap at least one stayed sheet being shifted;

a second transport device which transports a plurality of sheets overlapping each other by the sheet overlap device;

a plurality of stacking devices capable of stacking the plurality of sheets transported by the second transport device; and a controller which changes a shifting direction of sheets being overlapped by the sheet overlap device depending on which stacking device selected from among the plurality of stacking devices the sheets are to be transported to.

2. A post-processing apparatus according to claim 1, wherein the sheet overlap device overlaps the another sheet with the stayed sheet in a sheet transport direction.

3. A control method for a post-processing apparatus which sequentially receives sheets one by one from an image forming apparatus to execute a post-process on the sheets, comprising:

a first transport step of receiving sheets delivered from the image forming apparatus to transport the sheets;

a sheet overlap step of staying the sheets transported in the first transport step and causing another sheet to be transported in the first transport step to overlap at least one stayed sheet being shifted;

a second transport step of transporting a plurality of sheets overlapped with each other in the sheet overlap step;

a sheet stacking step of stacking the plurality of sheets transported in the second transport step on any one of a plurality of stacking devices; and a controlling step of changing a shifting direction of sheets being overlapped in the sheet overlap step depending on which stacking device selected from among the plurality of stacking devices the sheets are to be transported to.

4. A control method for a post-processing apparatus according to claim 3, wherein the sheet overlap step overlaps the another sheet with the stayed sheet in a sheet transport direction.

5. A control method for a post-processing apparatus which sequentially receives sheets one by one from an image forming apparatus to execute a post-process on the sheets, comprising:

a first transport step of receiving sheets delivered from the image forming apparatus to transport the sheets;

a sheet overlap step of staying the sheets transported in the first transport step and causing another sheet to be transported in the first transport step to overlap at least one stayed sheet;

a second transport step of transporting a plurality of sheets overlapped with each other in the sheet overlap step;

a sheet stacking step of stacking the plurality of sheets transported in the second transport step on any one of a plurality of stacking devices that perform a post-processing of the plurality of sheets; and a controlling step of changing control of sheet overlapping caused in the sheet overlap step depending on which stacking device selected from among the plurality of stacking devices the sheets are to be transported to.

6. A control method for a post-processing apparatus according to claim 5, wherein the sheet overlap step overlaps the another sheet with the stayed sheet in a sheet transport direction.

* * * * *